US005729785A

United States Patent [19]

Sakaizawa et al.

[11] Patent Number: 5,729,785

[45] Date of Patent: Mar. 17, 1998

[54] IMAGE FORMING APPARATUS WITH INK JET AND ELECTROPHOTOGRAPHIC IMAGE FORMING MEANS

[75] Inventors: Katsuhiro Sakaizawa; Yasushi Sato, both of Kawasaki; Yukihiro Ohzeki, Yokohama; Kenya Ogawa, Yokohama; Yasunori Chigono, Yokohama, all of Japan

[73] Assignee: Canon Kabushiki Kaisha, Tokyo, Japan

[21] Appl. No.: 563,289

[22] Filed: Nov. 28, 1995

[30] Foreign Application Priority Data

Dec. 7, 1994 [JP] Japan ..... 6-303825

[51] Int. Cl.[6] ..... G03G 15/00

[52] U.S. Cl. ..... 399/2

[58] Field of Search ..... 399/2, 6; 347/2, 347/43, 115

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,115,281 | 5/1992 | Ohtsuka et al. | 399/16 |
| 5,321,467 | 6/1994 | Tanaka et al. | 399/2 |
| 5,373,350 | 12/1994 | Taylor et al. | 399/2 |
| 5,561,500 | 10/1996 | Ohzeki et al. | 399/85 |
| 5,570,451 | 10/1996 | Sakaizawa et al. | 347/4 X |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—William J. Royer

*Attorney, Agent, or Firm*—Fitzpatrick, Cella, Harper & Scinto

[57] ABSTRACT

An image forming apparatus for forming an image on a recording medium includes a first conveying path for conveying a recording medium in order to form an image thereon using a first image forming device, a second conveying path for conveying a recording medium in order to form an image thereon using a second image forming device for forming an image according to an image forming method different from an image forming method of the first image forming device, a third conveying path for conveying a recording medium in order to form an image thereon using the first image forming device and the second image forming device, and a setting device for selectively setting one of a first conveying mode using the first conveying path, a second conveying mode using the second conveying path, and a third conveying mode using the third conveying path.

37 Claims, 13 Drawing Sheets

IMAGE FORMING APPARATUS WITH INK JET AND ELECTROPHOTOGRAPHIC IMAGE FORMING MEANS

BACKGROUND OF THE INVENTION

1. Field of the Invention

This invention relates to an image forming apparatus which includes a plurality of image forming means of different image forming methods.

2. Description of the Related Art

Recently, color copiers and color printers, in which a plurality of image forming means of different image forming methods are combined, have been proposed.

FIG. 13 illustrates such an image forming apparatus. The apparatus includes, within its main body M, first image forming means 10 of an electrophotographic type for forming monochrome toner images, and second image forming means 20 of an ink jet type for forming color ink images.

The first image forming means 10 includes a photosensitive drum 11 which is rotatably driven in the direction of an arrow R1. The surface of the photosensitive drum 11 is uniformly charged by a charger 12. An electrostatic latent image is formed on the surface of the photosensitive drum 1 by an exposure unit 13, and a monochrome toner image is formed by supplying the electrostatic latent image with toner particles using a developing unit 14. The toner image formed on the surface of the photosensitive drum 11 is transferred onto a recording medium (hereinafter termed a "recording material") P supplied from a sheet-feeding cassette 31, and the transferred toner image is then fixed on the surface of the recording material P by a fixing unit 17. Thus, the formation of the monochrome toner image by the first image forming means 10 is completed. Toner particles remaining on the surface of the photosensitive drum 11 after toner-image transfer are removed therefrom, and the photosensitive drum 11 is used for the next image formation.

The recording material P, on which the toner image has been formed, is conveyed toward the second image forming means 20 in the direction of an arrow K1. The second image forming means 20 includes a recording head 21 having a plurality of colors, serving as color-image recording means. The recording head 21 forms a color ink image so as to be superposed on the toner image on the recording material P.

The recording material P having the monochrome toner image and the color ink image formed on the surface thereof is discharged onto a sheet-discharging tray 32.

In the above-described image forming apparatus, a monochrome toner image is formed by the first image forming means 10 of the electrophotographic type having features of high speed and high quality. On the other hand, a color image is inexpensively formed by the second image forming means 20 of the ink jet type having a compact configuration. That is, a color image can be formed less expensively than by an electrophotographic color image forming apparatus, and a monochrome image can be formed at a higher speed than by an ink-jet color image forming apparatus.

SUMMARY OF THE INVENTION

The present invention has further developed the above-described prior art.

It is an object of the present invention to provide an image forming apparatus which can utilize features of respective image forming methods.

It is another object of the present invention to provide an image forming apparatus which can efficiently form monochrome images and color images.

It is still another object of the present invention to provide an image forming apparatus which can form both monochrome images and color images with high quality.

It is yet another object of the present invention to provide an image forming apparatus which can form monochrome images at high speed, and which can form color images with a compact device.

It is yet a further object of the present invention to provide an image forming apparatus which has a conveying path for a recording material for forming a monochrome image thereon, a conveying path for a recording material for forming a color image thereon, and a conveying path for a recording material for forming a monochrome image and a color image on the same surface thereof.

According to one aspect, the present invention, which achieves these objectives, relates to an image forming apparatus for forming an image on a recording medium, comprising a first conveying path for conveying a recording medium in order to form an image thereon using first image forming means, a second conveying path for conveying a recording medium in order to form an image thereon using second image forming means for forming an image according to an image forming method different from an image forming method of the first image forming means, a third conveying path for conveying a recording medium in order to form an image thereon using the first image forming means and the second image forming means, and setting means for selectively setting one of a first conveying mode using the first conveying path, a second conveying mode using the second conveying path, and a third conveying mode using the third conveying path.

According to another aspect, the present invention relates to an image forming apparatus for forming an image on a recording medium, comprising ink-jet image forming means for performing image formation according to an ink-jet image forming method of performing image formation by discharging ink from nozzles, a first conveying path for conveying a recording medium in order to form an image thereon using the ink-jet image forming means, electrophotographic image forming means for performing image formation according to an electrophotographic image forming method, a second conveying path for conveying a recording medium in order to form an image thereon using the electrophographic image forming means, a third conveying path for conveying a recording medium in order to form an image thereon using the ink-jet image forming means and the electrophotographic image forming means, and setting means for selectively setting one of a first conveying mode using the first conveying path, a second conveying mode using the second conveying path, and a third conveying mode using the third conveying path.

According to still another aspect, the present invention relates to an image forming apparatus for forming an image on a recording medium, comprising ink-jet image forming means for performing image formation according to an ink-jet image forming method of performing image formation by discharging ink from nozzles, a first conveying path for conveying a recording medium in order to form an image thereon using the ink-jet image forming means, electrophotographic image forming means for performing image formation according to an electrophotographic image forming method, a second conveying path for conveying a recording medium in order to form an image thereon using the electrophographic image forming means, a guiding conveying path for guiding a recording medium, on which image formation has been completed by the electrophotographic image forming means while passing through the second conveying path, to the first conveying path, and selection means for selecting one of (i) a first conveying mode for forming a color image on the recording medium by conveying the recording medium through the first conveying path, (ii) a second conveying mode for forming a monochrome image on the recording medium by conveying the recording medium through the second conveying path, and (iii) a third conveying mode for forming a color image after forming a monochrome image on the recording medium by conveying the recording medium through the first conveying path, the guiding conveying path, and the second conveying path.

According to yet another aspect, the present invention relates to an image forming apparatus for forming an image on a recording medium, comprising electrophotographic image forming means for performing image formation according to an electrophotographic image forming method, a first conveying path for conveying a recording medium in order to form an image thereon using the electrophotographic image forming means, ink-jet image forming means for performing image formation according to an ink-jet image forming method of performing image formation by discharging an ink liquid from nozzles, a second conveying path for conveying a recording medium in order to form an image thereon using the ink-jet image forming means, a guiding conveying path for guiding a recording medium, on which image formation has been completed by the electrophotographic image forming means while passing through the second conveying path, to the first conveying path, and selection means for selecting one of (i) a first conveying mode for forming a monochrome image on the recording medium by conveying the recording medium through the first conveying path, (ii) a second conveying mode for forming a color image on the recording medium by conveying the recording medium through the second conveying path, and (iii) a third conveying mode for forming a monochrome image after forming a color image on the recording medium by conveying the recording medium through the first conveying path, the guiding conveying path, and the second conveying path.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described with reference to the drawings.

First Embodiment

Figure 1:
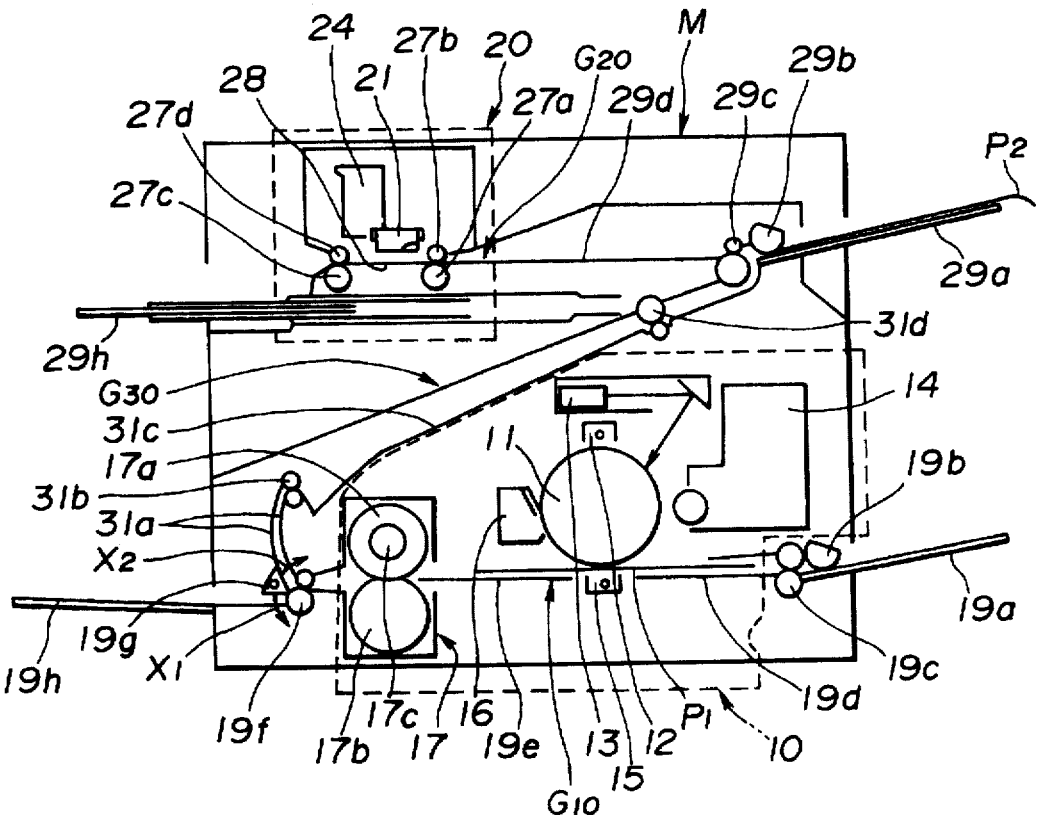
FIG. 1 is a schematic diagram illustrating the entire configuration of an image forming apparatus according to a first embodiment of the present invention.
Figure 2:
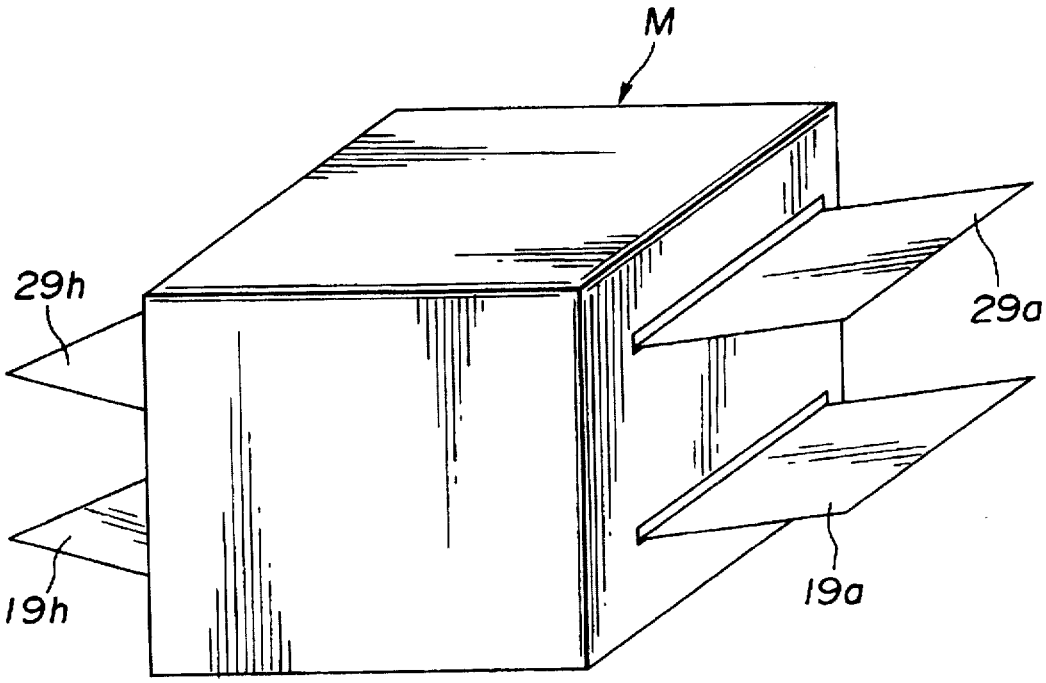
FIG. 2 is a perspective view illustrating an external appearance of the image forming apparatus shown in FIG. 1.

FIG. 1 is a schematic diagram illustrating the entire configuration of an image forming apparatus according to a first embodiment of the present invention. FIG. 2 is a perspective view illustrating an external appearance of the apparatus shown in FIG. 1. The image forming apparatus of the first embodiment can perform both ink jet recording (image formation according to an ink jet method) and electrophotographic recording (image formation according to an electrophotographic method) on the same recording material, i.e., "synthesized" or "multiplex" recording. In this specification, recording in which an ink image formed by ink jet recording and a toner image formed by electrophotographic recording are not superposed on the surface of the same recording material is termed "synthesized" recording, and recording in which the two images are superposed is termed "multiplex" recording.

First, a description will be provided of an outline of the image forming apparatus. The image forming apparatus shown in FIGS. 1 and 2 includes first image forming means 10 of an electrophotographic type for forming a monochrome toner image at a lower portion of a main body M of the image forming apparatus (hereinafter abbreviated a "main body"), and second image forming means 20 of an ink jet type for forming a color ink image at an upper portion of the main body M. The apparatus further includes a first conveying path $G_{10}$ for conveying a recording material $P_1$ on which a toner image is to be formed by the first image forming means 10, a second conveying path $G_{20}$ for conveying a recording material $P_2$ on which an ink image is to be formed by the second image forming means 20, and a third conveying path $G_{30}$ for connecting an exit of the first conveying path $G_{10}$ to an entrance of the second conveying path $G_{20}$. Any image other than a monochrome image is termed a color image. A recording material may comprise paper, a cloth, an OHP (overhead projector) sheet or the like.

Respective units will now be described in detail.

The first image forming means 10 is used for forming a monochrome toner image on the recording material $P_1$. The surface of a photosensitive drum 11, serving as an image bearing member, is uniformly charged by a charger 12. An optical system 13 projects an optical image corresponding to image information onto the surface of the photosensitive drum 11 after being charged, to form an electrostatic latent image thereon. A developing unit 14 supplies the electrostatic latent image with a black developer (hereinafter termed a "toner") to form a toner image. In synchronization with the formation of the toner image, the recording material $P_1$ is conveyed from a feeding tray (a first supply unit) **19*a* via a pickup roller 19*b*, a pair of registration rollers 19*c*, a guide member 19*d* and the like. The toner image formed on the photosensitive drum 11 is transferred onto the recording material $P_1$ by applying a transfer voltage to a transfer unit (transfer means) 15. The recording material $P_1$, on which the toner image has been transferred, is conveyed to a fixing unit (fixing means) 17 via a guide member 19***e*. The fixing unit 17 includes a fixing roller 17*a* incorporating a heater 17*c*, and a pressing roller 17*b* in contact with the fixing roller 17*a* by a predetermined pressing force. The fixing roller 17*a* fixes the unfixed toner image on the surface of the recording material $P_1$ by applying heat and pressure thereto while grasping and conveying the recording material $P_1$ between the rollers 17*a* and 17*b*. The recording material $P_1$ is then fed to a pair of discharging rollers 19*f*. When image formation is to be performed only by the first image forming means 10, a flapper 19*g* moves in the direction of an arrow $X_2$, and the recording material $P_1$ is discharged onto a discharging tray (a first discharging unit) 19*h*. When image formation is to be performed by both the first image forming means 10 and the second image forming means 20, the flapper 19*g* moves in the direction of an arrow $X_1$, and the recording material $P_1$ is conveyed toward the second image forming means 20 via a guide member 31*a*, a pair of conveying rollers 31*b*, a guide member 31*c*, a pair of conveying rollers 31*d*, and the like. Toner particles remaining on the surface of the photosensitive drum 11 after the transfer of the toner image are removed by a cleaning device 16, and the photosensitive drum 11 is used for the next image formation.

Figure 3:
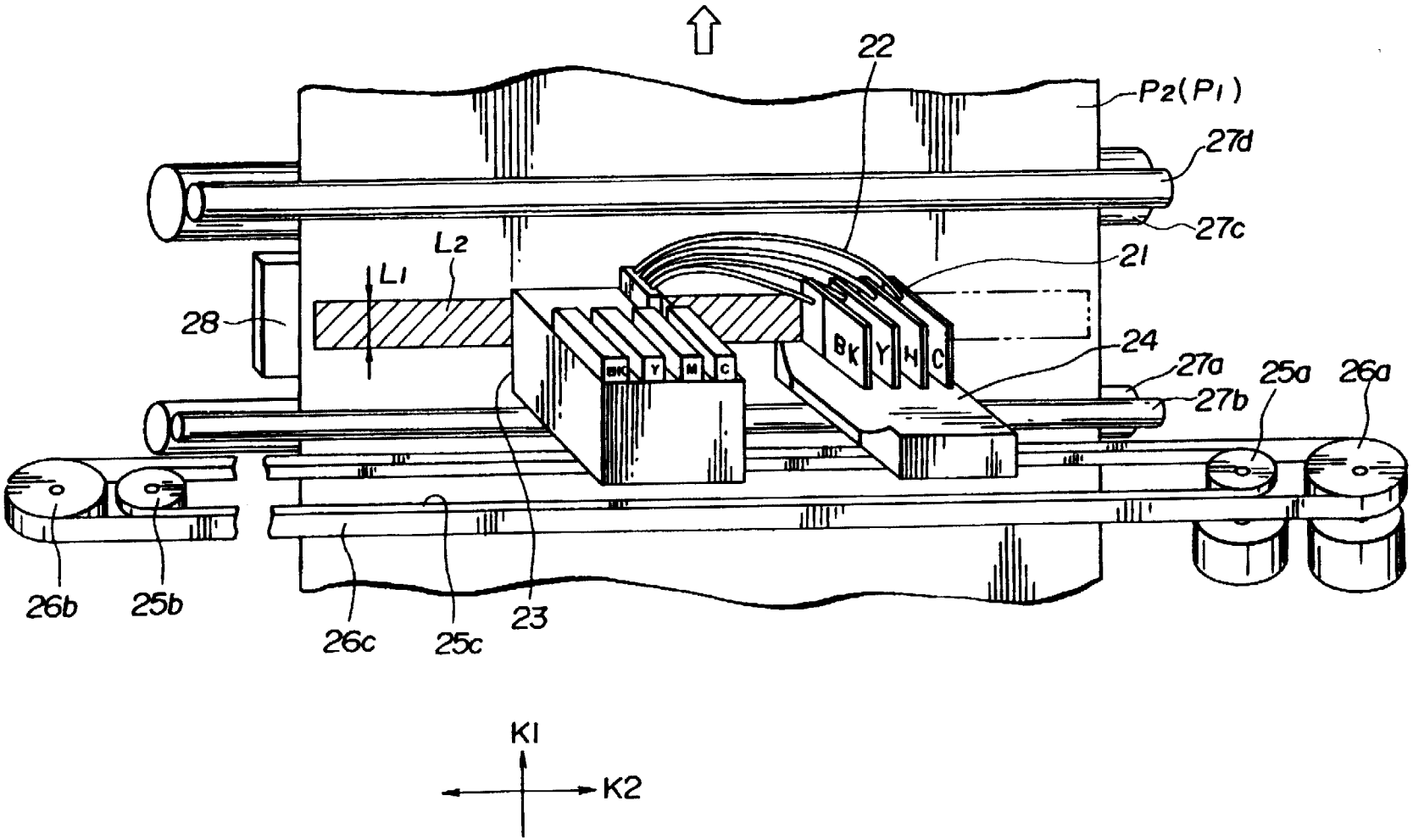
FIG. 3 is a perspective view illustrating the configuration of image forming means of an ink jet type of the apparatus shown in FIG. 1.

The second image forming means 20 is used for forming a color image, and has the configuration shown in FIGS. 1 and 3.

When forming an image by only the second image forming means 20, the recording material $P_2$ is supplied to the second image forming means 20 via a feeding tray (a second supply unit) 29*a*, a pickup roller 29*b*, a pair of registration rollers 29*c*, a guide member 29*d* and the like.

The second image forming means 20 adopts an ink jet method for performing recording by discharging an ink liquid from a recording head 21. That is, the recording head 21 includes fine liquid-discharging ports (orifices), a liquid channel, an energy operating unit provided at a portion of the liquid channel, and energy generation means for generating droplet-forming energy to be applied to a liquid present in the energy operating unit.

Such energy generation means may comprise, for example, electromechanical transducers, such as piezoelectric elements or the like, energy generation means for heating the liquid by radiating an electromagnetic wave, such as laser or the like, thereon and discharging droplets by the function of heat, or energy generation means for discharging droplets by heating the liquid by electrothermal transducers, such as heating elements having heating resistors, or the like.

Among these means, a recording head used in an ink-jet recording method in which liquid droplets are discharged by thermal energy can perform high-resolution recording because liquid-discharging ports (orifices) for forming and discharging droplets for recording can be arranged at high density. In particular, a recording head using electrothermal transducers as energy generation means is advantageous because it can be easily manufactured in a small size, can fully utilize a recent advanced technology in the semiconductor field and advantages in the IC (integrated circuit) technology and the microprocessing technology whose reliability has remarkably improved, can be easily assembled at high density, and can be manufactured with a low cost.

As shown in FIG. 3, the recording head 21 of the second image forming means 20 includes a plurality of ink discharging ports, arranged in the direction of an arrow K2 (a direction orthogonal to the direction of an arrow K1 which is the conveying direction of a recording material $P_2$), for ink of respective colors, i.e., C (cyan), M (magenta), Y (yellow) and BK (black). Ink of each color is supplied from an ink tank 23 to the corresponding port of the recording head 21 via an ink supply tube 22. The recording head 21 is mounted on a carriage 24, which is fixed to a portion of a belt 25*c* stretched between a driving pulley 25*a* and a driven pulley 25*b*, and is driven along a guide (not shown) in the direction of the arrow K2 with high precision. The ink tank 23 is fixed to a portion of a belt 26*c* stretched between a driving pulley 26*a* and a driven pulley 26*b*, and is movable along a guide (not shown) in the direction of the arrow K2 as is the recording head 21. By driving the ink tank 23 separately from the carriage 24 while minimizing the stress applied to the ink supply tube 22, propagation of vibration or the like generated by moving the ink tank 23, which is considerably heavy, to the recording head 21 is prevented.

The recording material $P_2$ is grasped by a pair of conveying rollers 27*a* and 27*b*, and a pair of discharging rollers 27*c* and 27*d*, and recording by the recording head 21 is performed between the two pairs of rollers. The conveying speed of the pair of discharging rollers 27*c* and 27*d* is set to be slightly higher than the conveying speed of the pair of conveying rollers 27*a* and 27*b*, and the recording material $P_2$ is held to be flat between the two pairs of rollers. In order to keep the recording material $P_2$ flat, the recording material $P_2$ may be attracted onto a platen 28 having a flat portion by the function of static electricity or air suction.

Recording by the recording head 21 is performed for the recording material $P_2$, which stops, in accordance with an image signal, along a recording line $L_2$ from the left-end side of the recording material $P_2$. When the recording head 21 reaches the right end of the recording material $P_2$ and therefore recording for one line is completed, the carriage 24 and the ink tank 23 return to the left end of the recording material $P_2$. At that time, the recording material $P_2$ is fed by the length of one line Li in the direction of the arrow K1 by the pair of conveying rollers 27*a* and 27*b*, and the pair of discharging rollers 27*c* and 27*d*, and stops again. By repeating such an operation, a color image is formed on the recording material $P_2$.

When performing image formation by both the first image forming means 10 and the second image forming means 20, the recording material $P_1$ is first conveyed to the pair of conveying rollers 31*d*, and is then supplied to the second image forming means 20 by the pair of registration rollers 29*c*, the guide member 29*d*, the pair of conveying rollers 27*a* and 27*b*, and the like, as in the case of the recording material $P_2$.

After forming an ink image on the surface of the recording material $P_1$ or $P_2$ conveyed to the second image forming means 20 in the above-described manner, the recording material $P_1$ or $P_2$ is discharged onto a discharging tray (a second discharging unit) 29*h* by the pair of discharging rollers 27*c* and 27*d*.

In the image forming apparatus shown in FIG. 1, the first conveying path $G_{10}$ conveys the recording material $P_1$, on which an image is to be formed by the first image forming means 10, and is configured by the guide members 19*d* and 19*e*, and the like. The second conveying path $G_{20}$ conveys the recording material $P_2$, on which an image is to be formed by the second image forming means 20, and is configured by the guide member 29*d* and the like. The third conveying path $G_{30}$ connects the exit of the first conveying path $G_{10}$ to the entrance of the second conveying path $G_{20}$, and is configured by the guide members 31*a* and 31*c*, and the like.

Accordingly, when a first conveying mode is selected by switching means as will be described later, the recording material $P_1$ is supplied from the feeding tray 19*a* present at a lower portion, and is conveyed along the first conveying path $G_{10}$. A monochrome toner image is formed on the recording material $P_1$ by the first image forming means 10, and the recording material $P_1$ is then discharged onto the tray 19*h* present at a lower portion. When a second conveying mode is selected by the switching means, the recording material $P_2$ is supplied from the feeding tray 29*a* present at an upper portion, and is conveyed along the second conveying path $G_{20}$. A color ink image is formed on the recording material $P_2$ by the second image forming means 20, and the recording material $P_2$ is then discharged onto the discharging tray 29*h* present at an upper portion. When a third conveying mode is selected by the switching means, the recording material $P_1$ is supplied from the feeding tray 19*a* present at the lower portion, and is conveyed along the first conveying path $G_{10}$. A monochrome toner image is formed on the recording material $P_1$ by the first image forming means 10, and the recording material $P_1$ is then conveyed along the third conveying path $G_{30}$ and further along the second conveying path $G_{20}$. A color ink image is formed on the recording material $P_1$ by the second image forming means 20, and the recording material $P_1$ is then discharged onto the discharging tray 29*h* present at the upper portion.

That is, when the third conveying mode is selected, a distinct monochrome toner image is formed on the recording material $P_1$ by the first image forming means 10, and then a color image is inexpensively formed on the recording material $P_1$ by the second image forming means 20, so that the toner image and the ink image are synthesized or multiplexed on the same recording material $P_1$.

Figure 4:
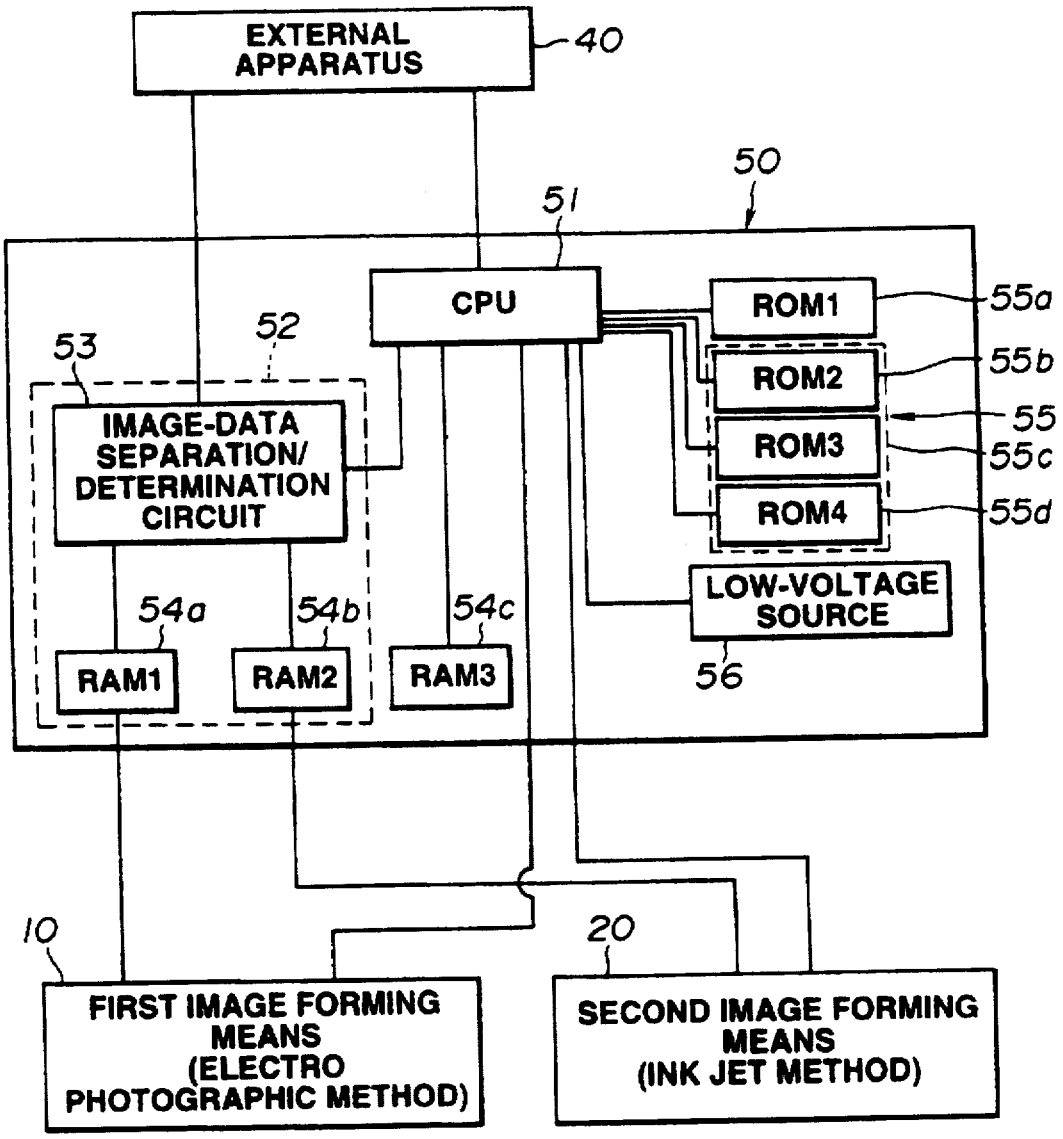
FIG. 4 is a block diagram illustrating the function of a controller of the apparatus shown in FIG. 1.

A description will now be provided of a controller (control device) 50 of the image forming apparatus for controlling driving of the above-described respective units with reference to a block diagram illustrating the function of the controller shown in FIG. 4. In FIG. 4, a CPU (central processing unit) 51 exchanges signals with an external apparatus 40, such as a computer or the like, and controls the entire apparatus. Conveyance switching means or setting means 52, which is one of the features of the embodiments of the present invention, receives and stores image data from the external apparatus 40, and selectively determines (sets) a conveying path of the recording material $P_1$ in the image forming apparatus based on the image data. The conveyance switching means 52 comprises an image-data separation/determination circuit 53 for separating the image data into monochrome-image data and color-image data, determining at the same time presence/absence of monochrome-image data and color-image data, and determining a feeding/conveying path in the image forming apparatus based on the result of the above-described determination, a RAM(random access memory)1 54*a* for storing monochrome-image data, and a RAM2 54*b* for storing color-image data. A ROM(read-only memory)1 55*a* stores an initial-operation conveying mode after turning on the image forming apparatus. Conveying-mode storage means 55 stores conveying modes of the image forming apparatus, and comprises a ROM2 55*b* for storing a conveying mode (a first conveying mode) of performing image formation by conveying the recording material $P_1$ from the feeding tray 19*a* to only the first image forming means 10 when monochrome-image data is present within the RAM1 55*a* and color-image data is absent within the RAM2 55*b* as a result of determination by the image-data separation/determination circuit 53, a ROM3 55*c* for storing a conveying mode (a second conveying mode) of performing image formation by conveying the recording material $P_2$ from the feeding tray 29*a* to only the second image forming means 20 when monochrome-image data is absent within the RAM1 55*a* and color-image data is present within the RAM2 55*b* as a result of determination by the image-data separation/determination circuit 58, and a ROM4 55*d* for storing a conveying mode (a third conveying mode) of performing image formation by conveying the recording material $P_1$ from the feeding tray 19*a* to the first image forming means 10, and then performing image formation by conveying the recording material $P_1$ to the second image forming means 20 via the third conveying path $G_{30}$ when monochrome-image data is present within the RAM1 55*a* and color-image data is present within the RAM2 55*b* as a result of determination by the image-data separation/determination circuit 53. A RAM3 54*c* temporarily stores a conveying mode read from the conveying-mode storage means 55. A low-voltage source 56 supplies respective devices (not shown) of the controller 50 including the CPU 51 with driving voltages.

Next, a description will be provided of examples of operations of the image forming apparatus in (1) the first conveying mode: when conveying the recording material $P_1$ to only the first image forming means 10, i.e., along only the first conveying path $G_{10}$ (only monochrome-image data), (2) the second conveying mode: when conveying the recording material $P_2$ to only the second image forming apparatus 20, i.e., along only the second conveying path $G_{20}$ (only color-image data), and (3) the third conveying mode: when conveying the recording material $P_1$ to both the first image forming means 10 and the second image forming means 20, i.e., along the first conveying path $G_{10}$, the third conveying path $G_{30}$, and the second conveying path $G_{20}$ (image data in which monochrome-image data and color-image data are mixed) with reference to the flowcharts shown in FIGS. 5, 6, 7 and 8.

Figure 5:
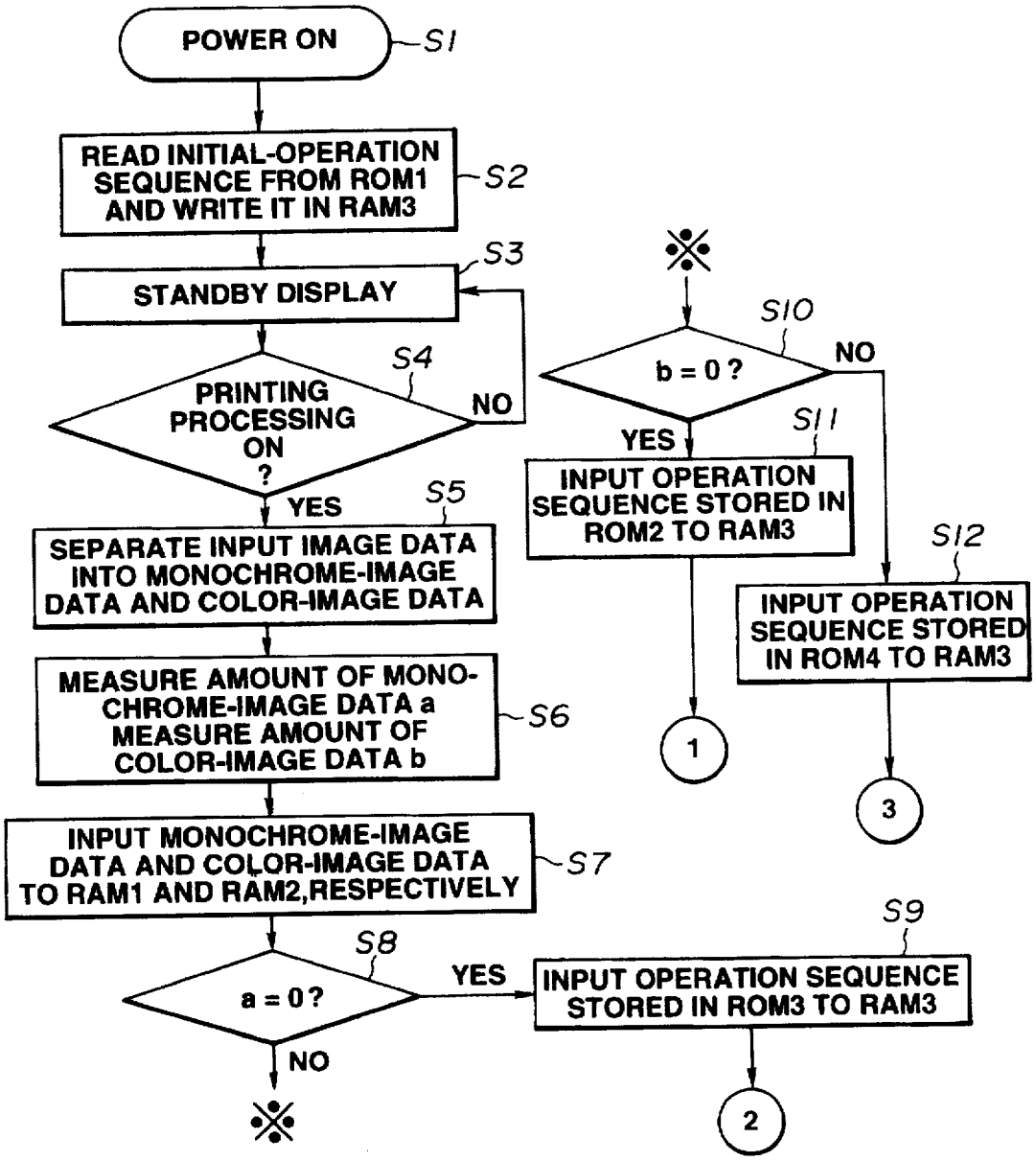
FIG. 5 is a flowchart illustrating initial operations of the apparatus shown in FIG. 1.

First, a description will be provided of an operation from switching on a main switch (not shown) of the image forming apparatus until one of the above-described three modes is determined and selected, with reference to FIGS. 1, 4 and 5.

When the operator has supplied the image forming apparatus with power by switching on the main switch, a driving voltage is applied from the low-voltage source 56 to the CPU 51 of the controller 50, and the operation is started (step S1). First, the CPU 51 reads an initial-operation sequence from the ROM1 storing an initial-operation mode of the image forming apparatus, and writes the read sequence in the RAM3 (step S2). Then, the CPU 51 causes the image forming apparatus to be in a state in which a printing signal and image data can be input from the external apparatus 40, according to the initial-operation sequence, and performs standby display (step S3). When a printing signal and image data have been input from the external apparatus 40 (step S4), the CPU 51 causes the image-data separation/determination circuit 53 of the conveyance switching means 52 to separate the input image data into monochrome-image data and color-image data (step S5). The separation may, for example, be performed by reading an instruction of a page description language from the external apparatus 40. An amount of monochrome-image data a, and an amount of color-image data b are measured for the separated monochrome-image data and color-image data, respectively (step S6). A number of bits of the monochrome-image data is measured as the amount a, and a number of bits of the color-image data is measured as the amount b. At the same time, the image-data separation/determination circuit 53 temporarily stores the monochrome-image data and the color-image data in the RAM1 54*a* and the RAM2 54*b*, respectively (step S7).

Then, the image-data separation/determination circuit 53 determines a conveying path for the recording material P by selecting one of the above-described conveying paths (conveying modes) (1)–(3) based on the measured amounts "a" and "b".

The determination is performed based on presence/absence of the amounts a and b.

Figure 8:
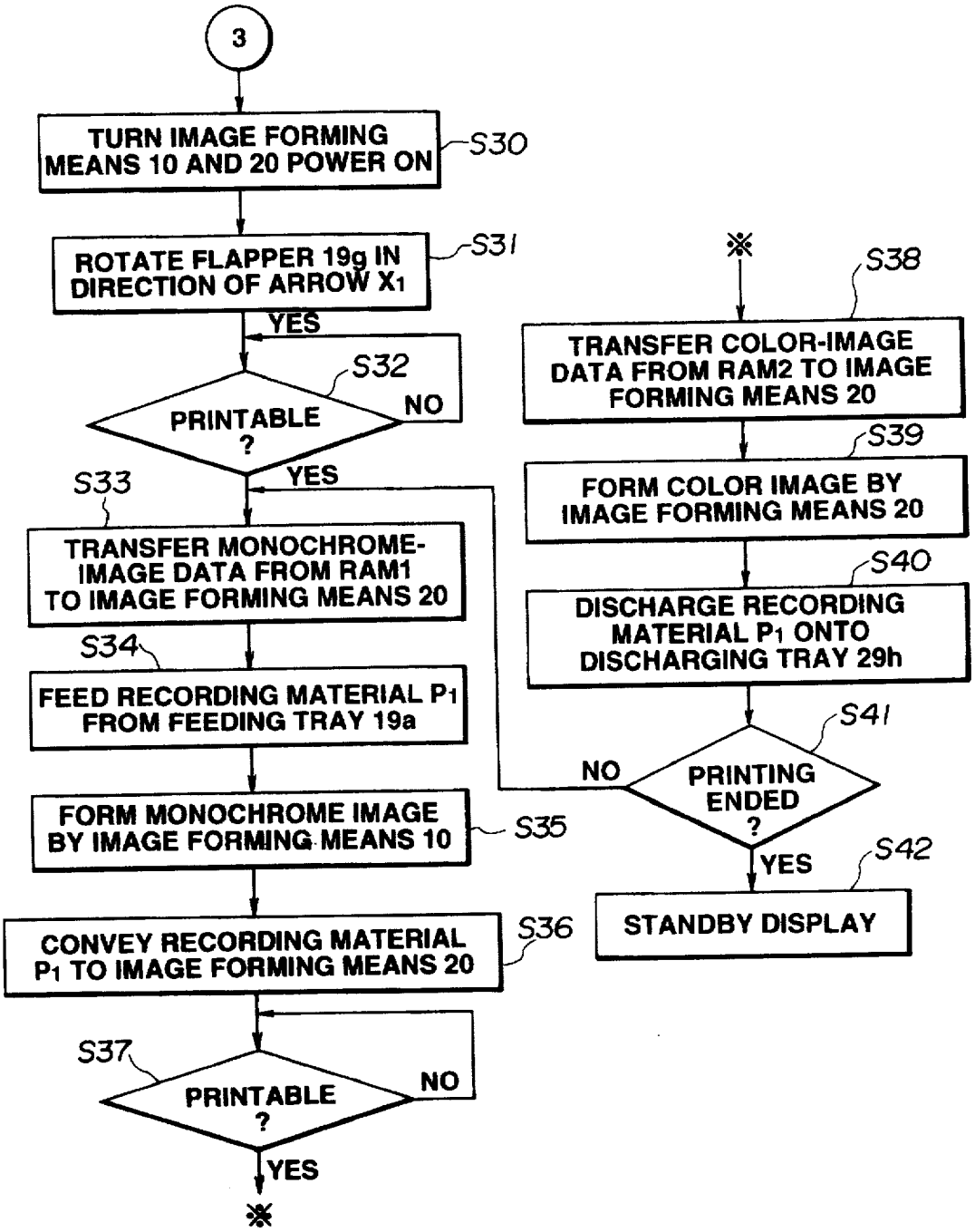
FIG. 8 is a flowchart illustrating the operation of a third conveying mode of the apparatus shown in FIG. 1.

First, presence/absence of the amount a is confirmed (step S8). If a=0, the input image data comprises only color-image data. Hence, the recording material $P_2$ is to be conveyed to only the second image forming means 20, and an operation sequence stored in the ROM3 is input to the RAM3 (step S9). If a≠0, presence/absence of the amount b is confirmed (step S10). If b=0, i.e., a≠0 and b=0, the input image data comprises only monochrome-image data. Hence, the recording material $P_1$ is to be conveyed to only the first image forming means 10, and an operation sequence stored in the ROM2 is input to the RAM3 (step S11). If b≠0, i.e., a≠0 and b≠0, the input image data comprises image data in which monochrome-image data and color-image data are mixed. Hence, the recording material $P_1$ is to be conveyed to the first image forming means 10 and the second image forming means 20, and an operation sequence stored in the ROM4 is input to the RAM3 (step S12). Thereafter, as shown in the flowchart of FIG. 8, the CPU 51 executes an operation mode for outputting a monochrome image by the image forming means 10 of the electrophotographic type, and outputting a color image by the image forming means 20 of the ink jet type.

Next, operation modes for the above-described conveying paths (1)–(3) will be sequentially described.

Figure 6:
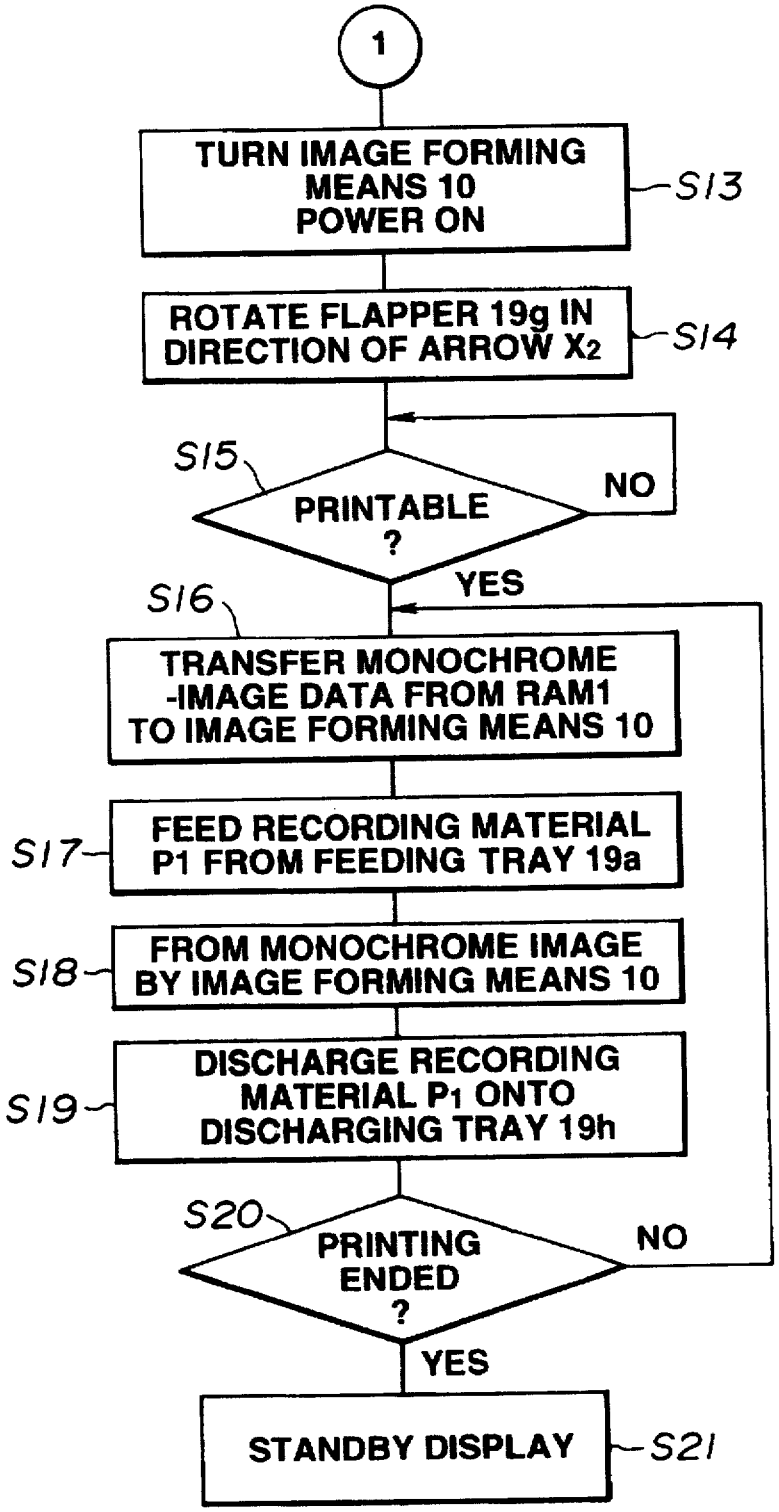
FIG. 6 is a flowchart illustrating the operation of a first conveying mode of the apparatus shown in FIG. 1.

First, a description will be provided of the case (1) in which the recording material $P_1$ is conveyed to only the first image forming means 10 (only monochrome-image data) with reference to FIGS. 1, 4 and 6.

First, the CPU 51 turns on the first image forming means 10 (step S13). At that time, the second image forming means 20 is not turned on. At the same time, since the recording material P is to be conveyed to only the first image forming means 10, a flapper 19*g* is rotated in the direction of an arrow $X_2$ so as to discharge the recording material $P_1$ onto the discharging tray 19*h* (step S14). When the fixing unit 17 of the image forming means 10 reaches a predetermined temperature, the image forming means 10 notifies the CPU S1 of a printable state (step S15), and controls the temperature of the fixing unit 17 to a fixing temperature. Then, the CPU 51 transfers monochrome-image data stored in the RAM1 to the image forming means 10 (step S16). The image forming means 10 executes an operation of forming a monochrome image according to the operation sequence stored in the ROM2. First, the recording material $P_1$ is fed and conveyed from the feeding tray 19*a* by the pickup roller 19*b* (step S17), and a monochrome image is formed by the first image forming means 10 according to the electrophotographic method (step S18). The recording material $P_1$ passing through the fixing unit 17 is discharged onto the discharging tray 19*h* by the flapper 19*g* (step S19). When a plurality of images are to be printed, the process returns to step S16, and the above-described procedures are repeated (step S20). When no image to be printed remains, a standby state is provided in order to accept a subsequent request of image formation (step S21).

As described above, in the case of only monochrome-image data, the recording material P is conveyed to only the first image forming means 10 and is output. Hence, high-speed output, which is one of advantages of the electrophotographic method, is achieved, and respective elements of the second image forming means 20 are not worn. Therefore, the process is economical. Since the second image forming means 20 is not operated, power consumption can be reduced. By providing the discharging tray 19*h* for the first image forming means 10, it is possible to shorten the time required for image formation, and to increase the throughput.

Figure 7:
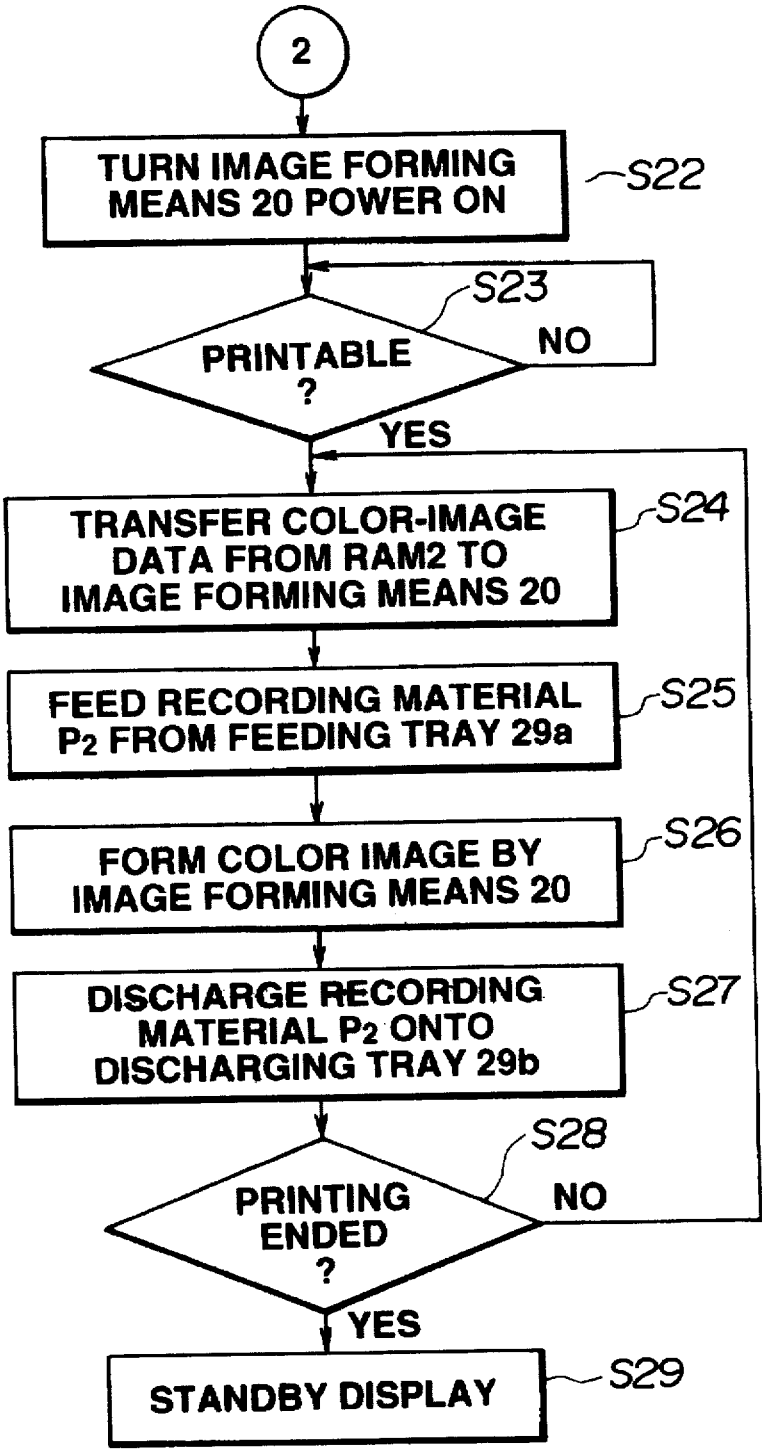
FIG. 7 is a flowchart illustrating the operation of a second conveying mode of the apparatus shown in FIG. 1.

Next, a description will be provided of the case (2) in which the recording material $P_2$ is conveyed to only the second image forming means 20 (only color-image data) with reference to FIGS. 1, 4 and 7.

First, the CPU 51 turns on the second image forming means 20 (step S22) to provide a state in which ink jet recording can be performed. At that time, the first image forming means 10 is not turned on. When a state in which a recording operation can be performed has been provided, the image forming means 20 notifies the CPU 51 of a printable state (step S23). Then, the CPU 51 transfers color-image data stored in the RAM2 to the image forming means 20 (step S24). The image forming means 20 executes an operation of forming a color image according to the operation sequence stored in the ROM3. First, the recording material $P_2$ is fed and conveyed from the feeding tray 29*a* by the pickup roller 29*b* (step S25), and a color image is formed by the second image forming means 20 according to the ink jet method (step S26). The recording material $P_2$, on which the color image has been formed, is discharged onto the discharging tray 29*h* (step S27). When a plurality of images are to be printed, the process returns to step S24, and the above-described procedures are repeated (step S28). When no image to be printed remains, a standby state is provided in order to accept a subsequent request of image formation (step S29).

As described above, in the case of only color-image data, since the recording material $P_2$ is conveyed to only the second image forming means 20, respective elements of the first image forming means 10 are not worn. Therefore, the process is economical. Since the first image forming means 10 is not operated, power consumption can be reduced. Furthermore, it is possible to perform one-point color recording, and to use an OHP sheet dedicated for ink jet recording as the recording material P. By providing the feeding tray 29*a* and the discharging tray 29*h* for the second image forming means 20 as in the case of the first image forming means 10, it is possible to shorten the time required for image formation, and to increase the throughput.

Next, a description will be provided of the case (3) in which the recording material $P_1$ is conveyed to the first image forming means 10 and the second image forming means 20 (image data in which monochrome-image data and color-image data are mixed) with reference to FIGS. 1, 4 and 8.

First, the CPU 51 turns on the first image forming means 10 (step S30). At the same time, the flapper 19*g* is rotated in the direction of an arrow $X_1$ so as to convey the recording material $P_1$ to the first image forming means 10 and the second image forming means 20 (step S31). When the fixing unit 17 of the image forming means 10 reaches a predetermined temperature, the image forming means 10 notifies the CPU 51 of a printable state (step S32), and controls the temperature of the fixing unit 17 to a fixing temperature. Then, the CPU 51 transfers monochrome-image data stored in the RAM1 to the image forming means 10 (step S33). The image forming means 10 executes an operation of forming a monochrome image according to the operation sequence stored in the ROM4. First, the recording material $P_1$ is fed and conveyed from the feeding tray 19*a* by the pickup roller 19*b* (step S34), and a monochrome image is formed by the first image forming means 10 according to the electrophotographic method (step S35) The recording material $P_1$, on which the monochrome image has been formed, is conveyed in the direction of the pair of conveying rollers 31*b* by the flapper 19*g* in order to be conveyed to the second image forming means 20 (step S36). The recording material $P_1$ is conveyed via the guide member 31*a*, the pair of conveying rollers 31*b*, the guide member 31*c*, the pair of conveying rollers 31*d*, and the pair of registration rollers 29*c*. When a state in which an ink-jet recording operation can be performed has been provided, the image forming means 20 notifies the CPU 51 of a printable state (step S37). Then, the CPU 51 transfers color-image data stored in the RAM2 to the image forming means 20 (step S38). The image forming means 20 forms a color image in accordance with the transferred color-image data according to the ink jet method (step S39). The recording material $P_1$, on which the image has been formed, is discharged onto the discharging tray 29*h* (step S40). When a plurality of images are to be printed, the process returns to step S33, and the above-described procedures are repeated (step S41). When no image to be printed remains, a standby state is provided in order to accept a subsequent request of image formation (step S42).

As described above, image formation can be performed also for image data in which monochrome-image data and color-image data are mixed.

As described above, in the image forming apparatus having the two image forming means 10 and 20 of different image forming methods, by providing the first conveying path $G_{10}$ for conveying the recording material $P_1$ to only the first image forming means 10, the second conveying path $G_{20}$ for conveying the recording material $P_2$ to only the second image forming means 20, and the first conveying path $G_{10}$, the third conveying path $G_{30}$ and the second conveying path $G_{20}$ for conveying the recording material P to the first image forming means 10 and the second image forming means 20, and the conveyance switching means 52 for selectively switching between these conveying paths, it is possible to prevent wear of components of the image forming apparatus which are not directly related to image formation, and to reduce power consumption. Furthermore, it is possible to perform one-point color recording, and to use an OHP sheet dedicated for ink jet recording as the recording material P.

In image formation by a plurality of image forming means of different image forming methods, by providing at least one discharging tray (first discharging unit) 19*h* in the first image forming means 10, it is possible to shorten the time required for image formation, and to increase the throughput.

It is thereby possible to provide an appropriate image forming apparatus which solves the above-described problems in the conventional image forming apparatus.

Second Embodiment

Figure 9:
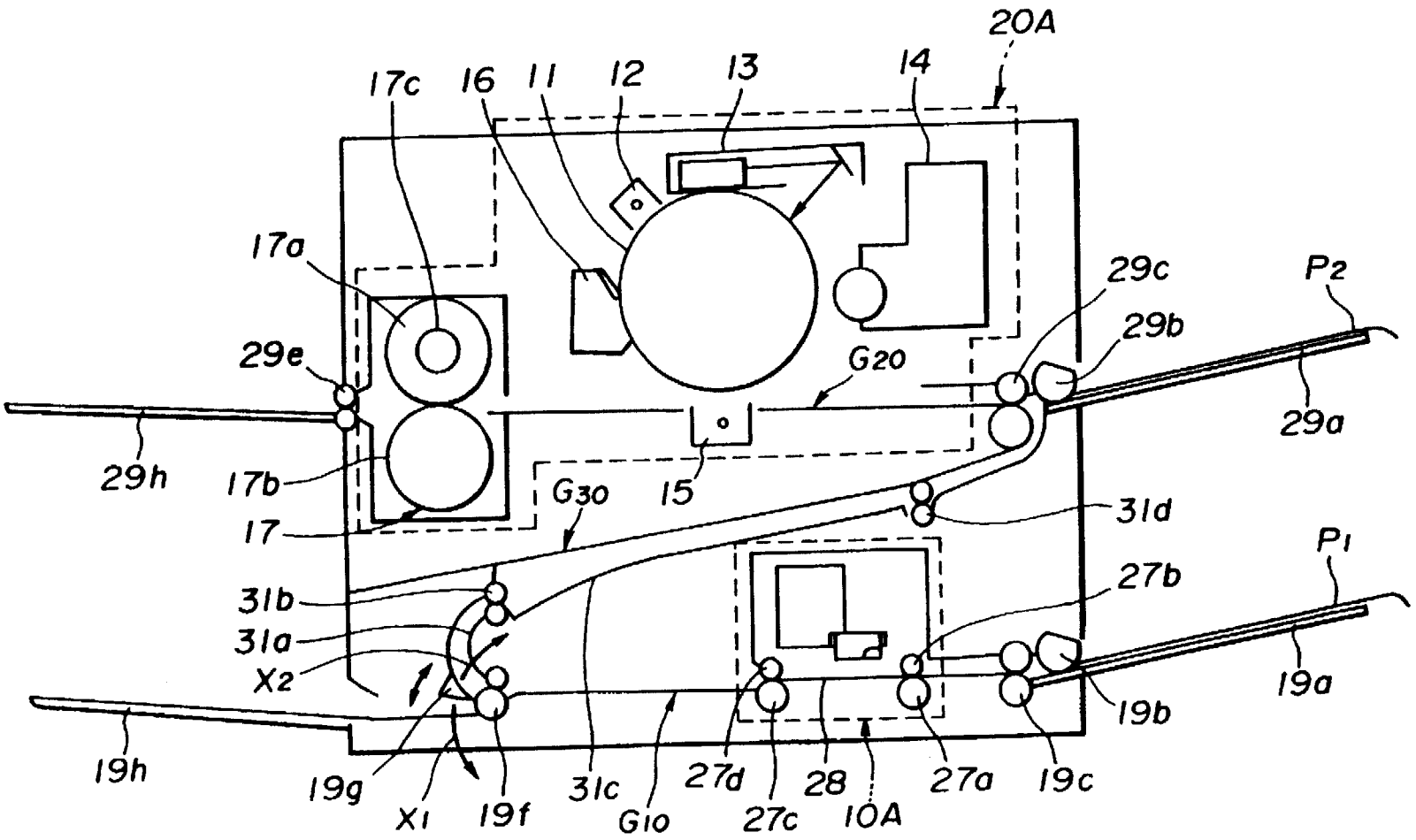
FIG. 9 is a schematic diagram illustrating the entire configuration of an image forming apparatus according to a second embodiment of the present invention.

A description will now be provided of a second embodiment of the present invention with reference to FIG. 9. In FIG. 9, components having the same functions as in the first embodiment are indicated by the same reference numerals, and description thereof will be omitted.

In the second embodiment shown in FIG. 9, an image forming apparatus uses the ink jet method for first image forming means 10A, and uses the electrophotographic method for second image forming means 20A.

A first conveying path $G_{10}$ is provided between a feeding tray 19*a* and a discharging tray 19*h* present at lower portions. A second conveying path $G_{20}$ is provided between a feeding tray 29*a* and a discharging tray 29*h* present at upper portions. A third conveying path $G_{30}$ is provided between an exit of the first image forming means 10A and an entrance of the second image forming means 20A. A pair of dicharging rollers 29*e* discharge a recording material $P_1$ or $P_2$, on which an image has been formed by the second image forming means 20A, onto the discharging tray 29*h*. The configuration of other components is substantially the same as in the first embodiment.

Figure 10:
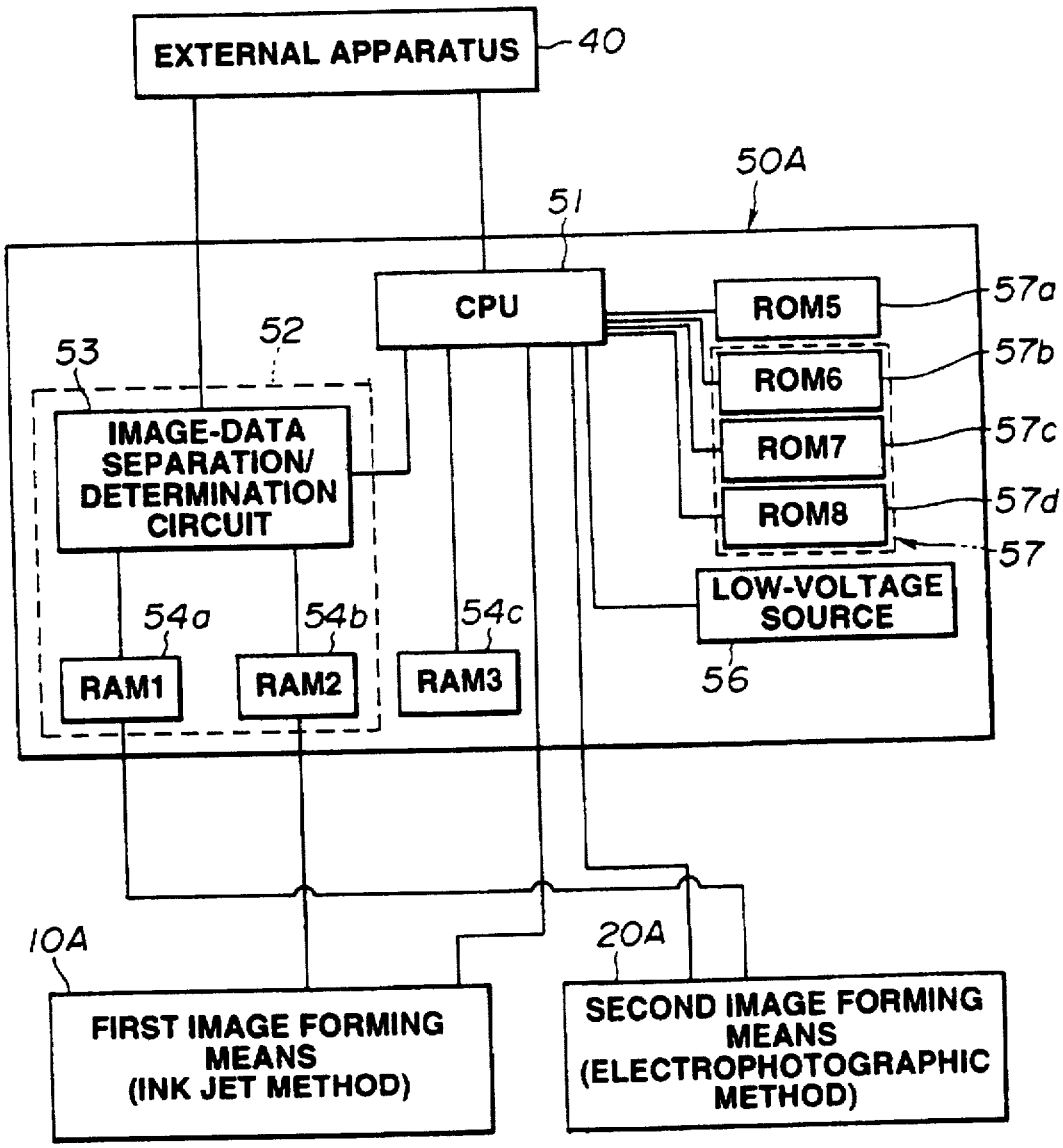
FIG. 10 is a block diagram illustrating the function of a controller of the apparatus shown in FIG. 9.

FIG. 10 is a block diagram illustrating the function of a controller 50A for controlling driving of the image forming apparatus. The second embodiment differs from the first embodiment in that it includes a ROM5 57*a* for storing initial-operation modes, and conveying-mode storage means 57. The conveying-mode storage means 57 comprises a ROM6 57*b*, a ROM7 57*c* and a ROM8 57*d*. The ROM6 57*b* stores a first conveying mode of performing image formation by conveying a recording material $P_1$ from the feeding tray 19*a* to only the first image forming means 10A when monochrome-image data is absent within a RAM1 54*a* and color-image data is present within a RAM2 54*b* after determination of an image-data separation/determination circuit 53. A ROM7 57*c* stores a second conveying mode of performing image formation by conveying a recording material $P_2$ from the feeding tray 29*a* to only the second image forming means 20A when monochrome-image data is present within the RAM1 54*a* and color-image data is absent within the RAM2 54*b* after determination of the image-data separation/determination circuit 53. A ROM8 57*d* stores a third conveying mode of performing image formation by conveying the recording material $P_1$ from the feeding tray 19*a* to the first image forming means 10A, and then performing image formation by conveying the recording material $P_1$ to the second image forming means 20A via the third conveying path $G_{30}$ when monochrome-image data is present within the RAM1 54*a* and color-image data is present within the RAM2 54*b* after determination of the image-data separation/determination circuit 53.

As in the first embodiment, the conveying path is determined based on presence/absence of data in the RAM1 54*a* and the RAM2 54*b*. If image data is present in only the RAM2 54*b*, the ROM6 57*b* is selected. If image data is present in only the RAM1 54*a*, the ROM7 57*c* is selected. If image data is present in both the RAM1 54*a* and the RAM2 54*b*, the ROM8 57*d* is selected.

In the case of a color image of one-point color recording, recording on OHP recording material dedicated for ink jet recording, or the like, the ROM6 57*b* is selected. The recording material $P_1$ is fed from the feeding tray 19*a*, and is discharged onto the discharging tray 19*h* after an image has been formed on the recording material $P_1$ according to the ink jet method by the first image forming means 10A. Also when the ink jet method is adopted for the first image forming means 10A, it is possible to output a color image of one-point color recording or to record on OHP recording material dedicated for ink jet recording, and to shorten the throughput.

When recording only a monochrome image, the ROM7 57*c* is selected. The recording material $P_2$ is fed from the feeding tray 29*a*, and is discharged onto the discharging tray 29*h* after an image has been formed on the recording material $P_2$ according to the electrophotographic method by the second image forming means 20A.

In the case of an image in which a monochrome image and a color image are mixed, the recording material $P_1$ is fed from the feeding tray 19*a*, and reaches the second image forming means 20A via the pair of discharging rollers 19*f*, the pair of conveying rollers 31*b*, the guide member 31*c*, the pair of conveying rollers 31*d* and the pair of registration rollers 29*c* after a color image has been formed on the recording material $P_1$ by the first image forming means 10A. The recording material $P_1$ is discharged onto the discharging tray 29*h* after a monochrome image has been formed by the second image forming means 20A. Usually, after forming an image on a recording material according to the ink jet method, the recording material is corrugated due to water in ink. In the above-described conveying path, however, since the recording material $P_1$ passes through the fixing unit 17 of the second image forming means 20A after image formation according to the ink jet method, water evaporates due to heat produced by the fixing unit 17, and the recording material $P_1$ is stretched by pressure. As a result, the recording material $P_1$ is not corrugated, and a beautiful image can be formed.

As described above, in the image forming apparatus having the two image forming means 10A and 20A of different image forming methods, by providing the first conveying path $G_{10}$ for conveying the recording material $P_1$ to only the first image forming means 10A, the second conveying path $G_{20}$ for conveying the recording material $P_2$ to only the second image forming means 20A, and the first conveying path $G_{10}$, the third conveying path $G_{30}$ and the second conveying path $G_{20}$ for conveying the recording material $P_1$ to the first image forming means 10A and the second image forming means 20A, and the conveyance switching means 52 for selectively switching between these conveying paths, it is possible to prevent wear of components of the image forming apparatus which do not contribute to image formation, and to reduce power consumption. As in the first embodiment, a specific recording material $P_1$ or $P_2$ may also be dealt with. By adopting the ink jet method for the first image forming means 10A and adopting the electrophotographic method for the second image forming means 20A, the recording material $P_1$ is not corrugated by ink, and a beautiful image output which is not stained by ink can be obtained in an image in which a monochrome image and a color image are mixed.

In image formation including a plurality of image forming means of different image forming methods, by providing at least one feeding means (the first feeding tray 19*a* or the second feeding tray 29*a*) and at least one discharging means (the first discharging tray 19*h* or the second discharging tray 29*h*)in the image forming means 10A or 10B, respectively, it is possible to shorten the time required for image formation, and to increase the throughput.

It is thereby possible to provide an appropriate image forming apparatus which solves the above-described problems in the conventional image forming apparatus.

Third Embodiment

Figure 11:
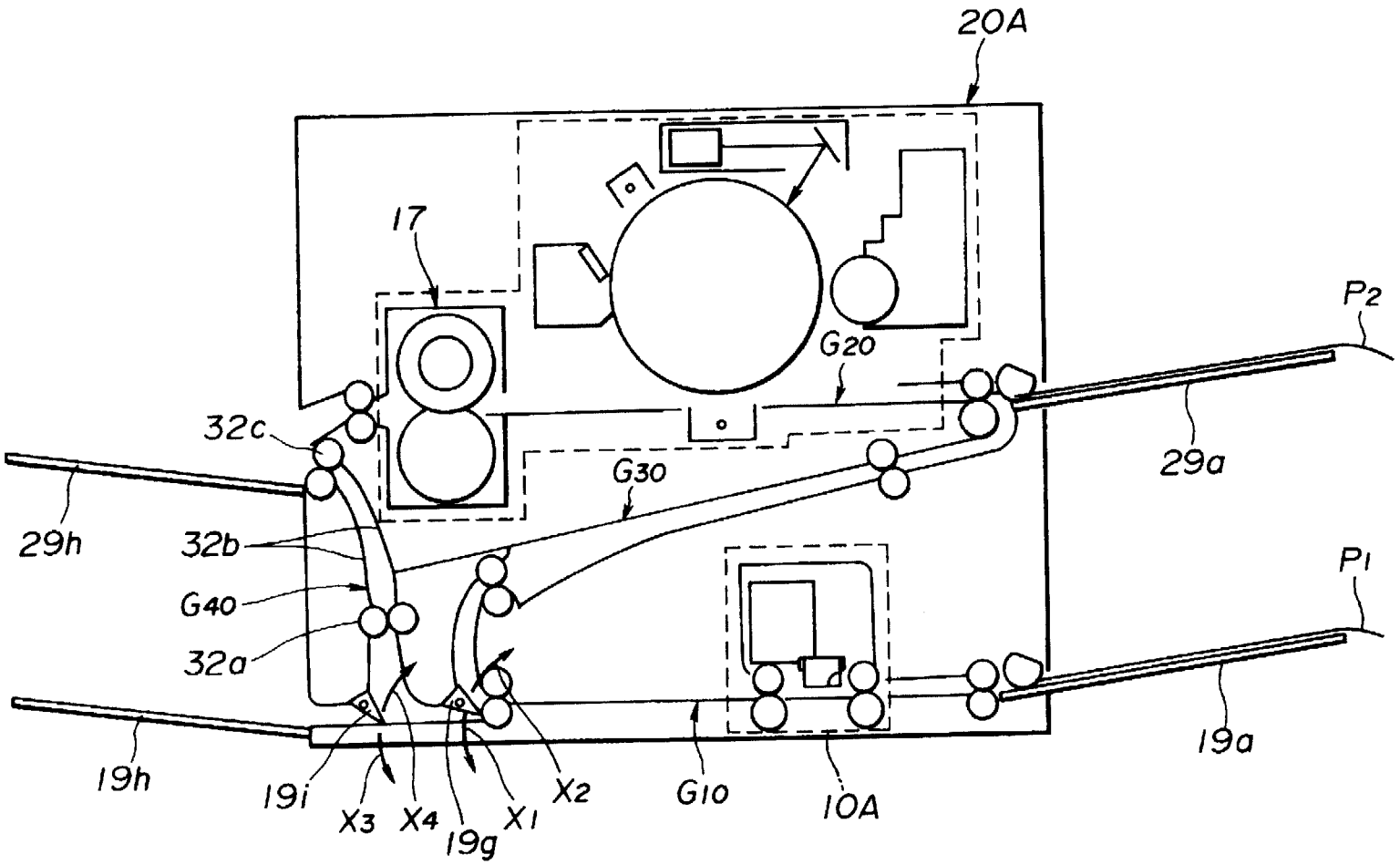
FIG. 11 is a schematic diagram illustrating the entire configuration of an image forming apparatus according to a third embodiment of the present invention.

A description will now be provided of a third embodiment of the present invention with reference to FIG. 11. In FIG. 11, components having the same functions as in the second embodiment are indicated by the same reference numerals, and description thereof will be omitted.

In the third embodiment, as in the second embodiment, the ink jet method is adopted for first image forming means 10A, and the electrophotographic method is adopted for second image forming means 20A. The third embodiment has a feature in that even in the case of recording only a color image, a fourth conveying path $G_{40}$ for discharging a recording material $P_1$ onto a discharging tray 29*h* of second image forming means 20A without passing the recording material $P_1$ through the second image forming means 20A is provided.

Next, a description will be provided of conveying paths of the recording material $P_1$, $P_2$.

An image in which a monochrome image and a color image are mixed is dealt with in the same manner as in the second embodiment. Hence, description thereof will be omitted.

Figure 12:
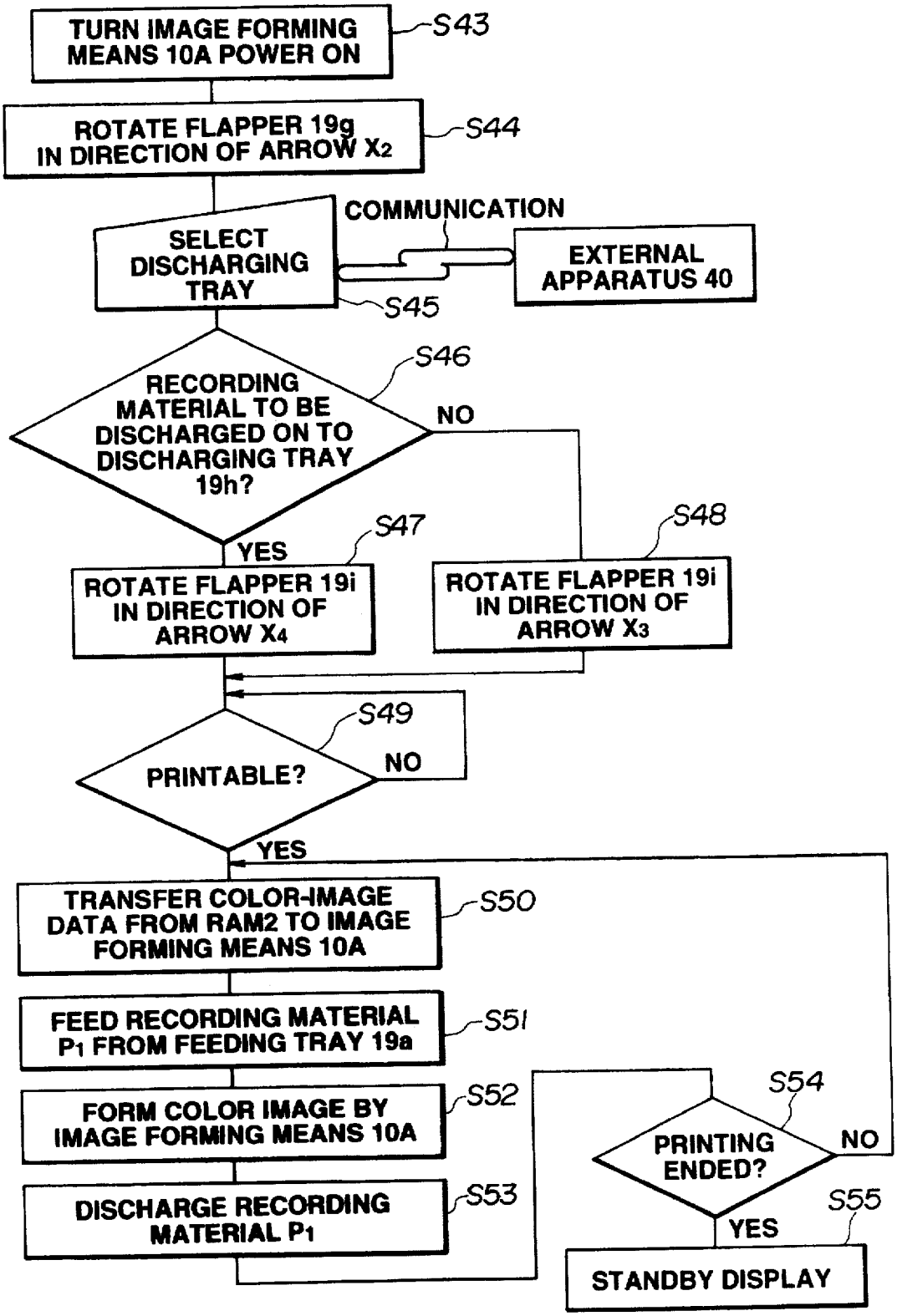
FIG. 12 is a flowchart illustrating the operation of a first conveying mode of the apparatus shown in FIG. 11.
Figure 13:
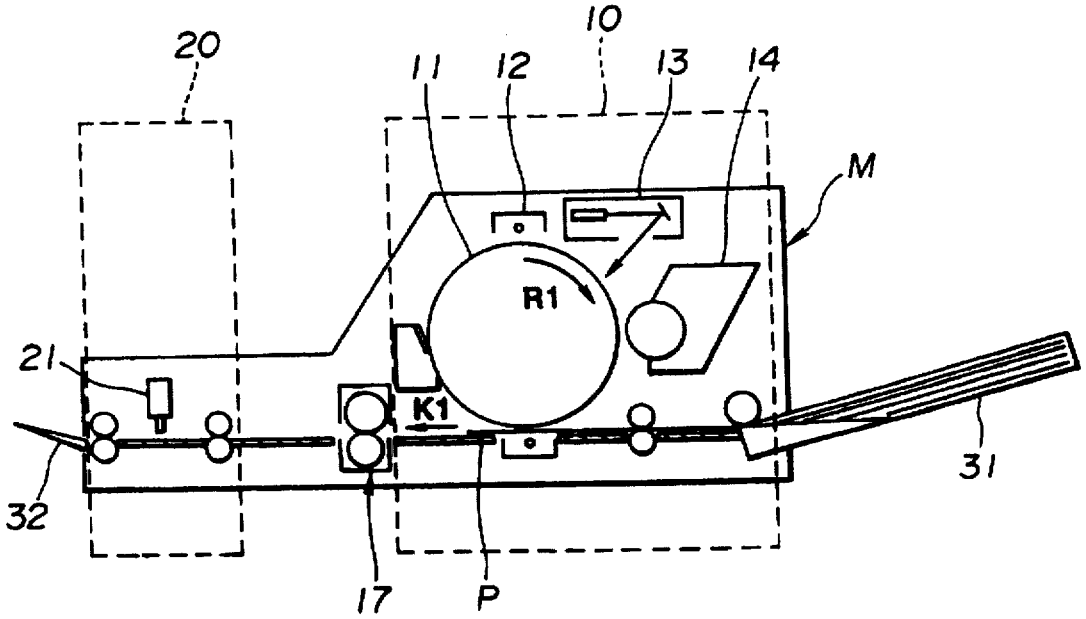
FIG.13 (PRIOR ART)
FIG. 13 is a schematic diagram illustrating the entire configuration of a conventional image forming apparatus.

A description will now provided of the case of only a color image with reference to FIGS. 11 and 12.

When image data comprises only color-image data (stored in the RAM2) as a result of determination of the image-data separation/determination circuit 93, data for forming a color image stored in the ROM7 is written in the RAM3. Thereafter, the image forming means 10A is turned on by the CPU 51 (step 243). At the same time, since the recording material $P_1$ is to be conveyed to only the first image forming means 10A, the flapper 19*g* is rotated in the direction of the arrow $X_2$ (step S44). In order to select whether the recording material $P_1$ is to be discharged onto the discharging tray 19*h* or onto the discharging tray 29*h*, communication is performed with the external apparatus 40, and an input of determination of the discharging tray from the external apparatus 40 is awaited (step S45). If the input (step S46) indicates that the recording material P is to be discharged onto the discharging tray 19*h*, a flapper 19*i* is rotated in the direction of an arrow $X_4$ (step S47). If the input indicates that the recording material P is to be discharged onto the discharging tray 29*h*, the flapper 19*i* is rotated in the direction of an arrow $X_3$ (step S48). Thereafter, when the first image forming means 10A becomes in a printable state, the CPU 51 is notified of that fact (step S49). Then, the CPU 51 transfers color image data stored in the RAM2 to the image forming means 10A (step S50). Thereafter, the recording material $P_1$ is fed from the feeding tray 19*a* (step S51), and image formation is performed by the first image forming means 10A (step S52) as in the second embodiment. Then, the recording material $P_1$ reaches the flapper 19*i*.

If the discharging tray 19*h* is selected in step S45, the flapper 19*i* is rotated in the direction of the arrow $X_4$ to block the direction toward a pair of conveying rollers 32*a*. Hence, the recording material $P_1$ is directly discharged onto the discharging tray 19*h*. If the discharging tray 29*h* is selected in step S45, the flapper 19*i* is rotated in the direction of the arrow $X_3$ to block the direction toward the discharging tray 19*h*. Hence, the recording material $P_1$ passes through the pair of conveying rollers 32*a*, guide members 32*b* and a pair of discharging rollers 32*c*, and is discharged onto the discharging tray 29*h* (step S53). When a plurality of images are to be recorded, the process returns to step S50, and the above-described procedures are repeated (step S54). When no image to be printed remains, a standby state is provided in order to accept a request to form the next image (step S55).

By arranging the apparatus such that the recording material $P_1$, on which an image has been formed by the first image forming means 10A, can be discharged onto the discharging tray 29*h* of the second image forming means 20A in the above-described manner, images can be discharged onto the same discharging tray 29*h* even if image data changes while outputting a plurality of images. Hence, it is possible to save time to insert a recording material $P_1$ for a color image after outputting a plurality of monochrome images. That is, the user need not perform a troublesome operation even if a single color-image page is present among a plurality of monochrome-image pages.

The method of selecting conveying modes is not limited to the method shown in the above-described embodiments. For example, the operator may select one of first, second and third conveying modes by depressing one of buttons for assigning modes (not shown).

Fourth Embodiment

Although in the above-described embodiments, the case of adopting the electrophotographic method and the ink jet method for a plurality of image forming means of different image forming methods has been illustrated, the present invention is not limited to such image forming means. For example, a thermal recording method, a thermal transfer recording method or the like may also be adopted.

The present invention has excellent effects particularly in a recording apparatus using a recording head of an ink jet method, in which recording is performed by forming flying droplets utilizing thermal energy, from among ink jet methods.

The typical structure and the principle of such apparatuses are preferably the ones disclosed, for example, in U.S. Pat. Nos. 4,723,129 and 4,740,798. The disclosed methods are applicable to a so-called on-demand type and a continuous type. Particularly, however, it is suitable for the on-demand type because the principle is such that at least one driving signal is applied to an electrothermal transducer disposed on a liquid (ink) retaining sheet or liquid channel, the driving signal being enough to provide such a quick temperature rise beyond a departure from nucleate boiling point, by which the thermal energy is provided by the electrothermal transducer to produce film boiling on the heating portion of the recording head, whereby a bubble can be formed in the liquid (ink) corresponding to each of the driving signals. By the development and contraction of the bubble, the liquid (ink) is discharged through a discharging port to produce at least one droplet. The driving signal is preferably in the form of a pulse, because the development and contraction of the bubble can be effected instantaneously, and therefore, the liquid (ink) is discharged with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 in which the heating portion is disposed at a bent portion, as well as the structure (a linear liquid channel or an orthogonal liquid channel) of the combination of the discharging port, the liquid channel and the electrothermal transducer as disclosed in the above-mentioned patents. In addition, the present invention is applicable to the structure disclosed in Japanese Patent Laid-Open Application (Kokai) No. 59-123670 (1984) wherein a common slit is used as the discharging port for a plurality of electrothermal transducers, and to the structure disclosed in Japanese Patent Laid-Open Application (Kokai) No. 59-138461 (1984) wherein an opening for absorbing pressure waves of the thermal energy is formed corresponding to the discharging ports. This is because the present invention is effective to perform recording with certainty and at high efficiency regardless of the type of the recording head.

The present invention may also be effectively applied to a full-line-type recording head having a length corresponding to the maximum width of a recording medium which can be recorded by the recording apparatus. Such a recording head may be configured by a combination of a plurality of recording heads for covering the length of the head, or by a single integrally-formed recording head In addition, the present invention is applicable to a serial-type recording head, such as the above-described one, to a replaceable chip-type recording head which is connected electrically to the main body of the apparatus and which can be supplied with the ink flow when it is mounted in the main body, or to a cartridge-type recording head having an integral ink container.

The provision of recovery means, preliminary auxiliary means, or the like for the recording head in the recording apparatus is preferable, because the effects of the present invention can be further stabilized. Examples of such means include capping means for the recording head, cleaning means therefor, pressure or suction means, and an electrothermal transducer, an additional heating element, or preliminary heating means formed by a combination of the electrothermal transducer and the additional heating element. It is also effective for performing stable recording to provide preliminary discharging means of performing a discharging operation other than a recording operation.

As regards the variation of the recording head mountable, it may be a plurality of heads corresponding to a plurality of ink materials having different recording colors and densities. The present invention is effectively applied to an apparatus having at least one of a monochromatic mode mainly with black, a multicolor mode with different color ink materials and/or a full-color mode using the mixture of the colors, which may be an integrally formed recording head or a combination of a plurality of recording heads.

Furthermore, in the foregoing embodiments, the ink has been liquid. It also may be an ink material which is solid below the room temperature but is softened or liquefied at the room temperature. Since the ink is kept within a temperature range between 30° C. and 70° C., in order to stabilize the viscosity of the ink to provide the stabilized discharge in the usual ink jet method, the ink may be such that it is liquid within the temperature range when a recording signal is applied. In one of them, the temperature rise due to the thermal energy is positively prevented by consuming it for the state change of the ink from the solid state to the liquid state. Another ink material is solidified when it is left unused, to prevent the evaporation of the ink. In either of these cases, in response to the application of the recording signal producing thermal energy, the ink is liquefied, and the liquefied ink may be discharged. Another ink material may start to be solidified when it reaches the recording medium. The present invention is also applicable to such an ink material as is liquefied by the application of the thermal energy. Such an ink material may be retained as a liquid or solid material in through holes or recesses formed in a porous sheet as disclosed in Japanese Patent Laid-Open Application (Kokai) Nos. 54-56847 (1979) and 60-71260 (1985). The sheet is arranged to face the electrothermal transducers. The most effective one of the techniques described above is the film boiling system.

An ink-jet recording apparatus of the present invention may be used, for example, in the form of an image output terminal of an information processing apparatus, such as a computer or the like, a copier combined with a reader or the like, or a facsimile apparatus having transmission and reception functions.

As described above, according to the foregoing embodiments, in an image forming apparatus including two image forming means of different image forming methods, by selectively setting one of three modes relating to conveying paths, i.e., a first mode of using a first conveying path (first image forming means), a second mode of using a second conveying path (second image forming means), and a third mode of using the first conveying path, a third conveying path and the second conveying path (the first image forming means and the second image forming means) by switching means, it is unnecessary to use a conveying path (image forming means) which does not directly contribute to image formation, and to operate the corresponding image forming means. Hence, unnecessary wear and degradation can be effectively prevented, and the recording material need not pass through the unnecessary conveying path. As a result, high-speed image formation can be realized.

When conveying the recording material to one of the image forming means of the image forming apparatus, since power consumption of the other image forming means to which the recording material is not conveyed is controlled by control means, image formation can be performed with low power consumption.

As described above, according to the foregoing embodiments, when performing image formation on a recording material, the image forming apparatus can selectively switch between the first conveying mode, the second conveying mode and the third conveying mode.

When requiring image formation by only the first image forming means, the first conveying path is used by selecting the first conveying mode. At that time, it is unnecessary to use the second image forming means, and the second conveying path and the third conveying path.

When requiring image formation by only the second image forming means, the second conveying path is used by selecting the second conveying mode. At that time, it is unnecessary to use the first image forming means, and the first conveying path and the third conveying path.

When requiring image formation by the first image forming means and the second image forming means, the first conveying path, the third conveying path and the second conveying path are used by selecting the third conveying mode.

That is, by providing the first conveying path, the second conveying path and the third conveying path for conveying a recording material used for image formation, and switching means for switching between these paths, it is possible to use only image forming means and conveying paths necessary for actual image formation, and not to use other unnecessary image forming means and conveying paths.

As described above, according to the present invention, it is possible to provide an image forming apparatus which can utilize advantages of respective image forming means.

The individual components shown in outline or designated by blocks in the drawings are all well known in the image forming apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming an image on a recording medium with first image forming means for forming an image according to a first image forming method and second image forming means for forming an image according to a second image forming method different from the first image forming method, said apparatus comprising:

a first conveying path for conveying a recording medium in order to form an image thereon using the first image forming means;

a second conveying path for conveying a recording medium in order to form an image thereon using the second image forming means;

a third conveying path for conveying a recording medium in order to form an image thereon using the first image forming means and the second image forming means; and setting means for selectively setting one of a first conveying mode using said first conveying path, a second conveying mode using said second conveying path, and a third conveying mode using said third conveying path, wherein only said first conveying path is used in the first conveying mode and only said second conveying path is used in the second conveying mode.

2. An image forming apparatus according to claim 1, wherein said third conveying path further comprises a fourth conveying path for connecting an exit of said second conveying path to an entrance of said first conveying path, and wherein when the third conveying mode is set, the recording medium is conveyed through said second conveying path, said fourth conveying path, and said first conveying path.

3. An image forming apparatus according to claim 1 or 2, further comprising:

a first feeding tray for feeding the recording medium to said first conveying path;

a first discharging tray for discharging the recording medium on which image formation has been performed by the first image forming means while passing through said first conveying path;

a second feeding tray for feeding the recording medium to said second conveying path; and a second discharging tray for discharging the recording medium on which image formation has been performed by the second image forming means while passing through said second conveying path, wherein said first conveying path is disposed above said second conveying path, wherein said first feeding tray is disposed above said second feeding tray, and wherein said first discharging tray is disposed above said second discharging tray.

4. An image forming apparatus according to claim 3, further comprising:

an additional conveying path for connecting an exit of said second conveying path to said first discharging tray, wherein the recording medium passing through said second conveying path can be selectively discharged onto one of said first discharging tray and said second discharging tray.

5. An image forming apparatus according to claim 1 or 2, further comprising:

control means for reducing power consumption in the second image forming means when the first conveying mode is set, and for reducing power consumption in the first image forming means when the second conveying mode is set.

6. An image forming apparatus according to claim 2, further comprising:

a first feeding tray for feeding the recording medium to said first conveying path;

a first discharging tray for discharging the recording medium on which image formation has been performed by the first image forming means while passing through said first conveying path;

a second feeding tray for feeding the recording medium to said second conveying path; and a second discharging tray for discharging the recording medium on which image formation has been performed by the second image forming means while passing through said second conveying path, wherein said first conveying path is disposed above said second conveying path, said first feeding tray is disposed above said second feeding tray, and said first discharging tray is disposed above said second discharging tray, and wherein when the first conveying mode is set, the recording medium fed from said first feeding tray passes through said first conveying path, and is discharged onto said first discharging tray after image formation by the first image forming means has been performed, when the second conveying mode is set, the recording medium fed from said second feeding tray passes through said second conveying path, and is discharged onto said second discharging tray after image formation by the second image forming means has been performed, and when the third conveying mode is set, the recording medium fed from said second feeding tray passes through said second conveying path, then passes through said fourth conveying path to said first conveying path after image formation by the second image forming means has been performed, and is discharged onto said first discharging tray after image formation by the first image forming means has been performed.

7. An image forming apparatus according to claim 1 or 2, wherein the first image forming means uses an ink jet method for forming the image on the recording medium by discharging an ink liquid.

8. An image forming apparatus according to claim 1 or 2, where in the first image forming means uses an electrophotographic image forming method for forming the image on the recording medium by forming a toner image on an electrophotographic member and transferring the toner image onto the recording medium.

9. An image forming apparatus according to claim 1 or 2, wherein the second image forming means uses an ink jet method for forming the image on the recording medium by discharging an ink liquid.

10. An image forming apparatus according to claim 1 or 2, wherein the second image forming means uses an electrophotographic image forming method for forming the image on the recording medium by forming a toner image on an electrophotographic member and transferring the toner image onto the recording medium.

11. An image forming apparatus according to claim 7, wherein said image forming means of the ink jet method comprises an electrothermal transducer for generating thermal energy for discharging the ink liquid.

12. An image forming apparatus according to claim 11, wherein said image forming means of the ink jet method discharges the ink liquid from discharging ports utilizing film boiling generated in the ink liquid by the thermal energy supplied from said electrothermal transducer.

13. An image forming apparatus according to claim 9, wherein said image forming means of the ink jet method comprises an electrothermal transducer for generating thermal energy for discharging the ink liquid.

14. An image forming apparatus according to claim 13, wherein said image forming means of the ink jet method discharges the ink liquid from discharging ports utilizing film boiling generated in the ink liquid by the thermal energy supplied from said electrothermal transducer.

15. An image forming apparatus according to claim 1, wherein one of the first image forming means and the second image forming means forms the image on the recording medium using a thermal transfer recording method or a thermal recording method.

16. An image forming apparatus according to claim 1, wherein said setting means comprises an image-data separation/determination circuit, and wherein the conveying mode is set based on determination of said image-data separation/determination circuit whether image data input from an external apparatus comprises only monochrome-image data, only color-image data, or both monochrome-image data and color-image data.

17. An image forming apparatus for forming an image on a recording medium, comprising:

ink-jet image forming means for performing image formation according to an ink-jet image forming method of performing image formation by discharging ink from nozzles;

a first conveying path for conveying a recording medium in order to form an image thereon using said ink-jet image forming means;

electrophotographic image forming means for performing image formation according to an electrophotographic image forming method;

a second conveying path for conveying a recording medium in order to form an image thereon using said electrophographic image forming means;

a third conveying path for conveying a recording medium in order to form an image thereon using said ink-jet image forming means and said electrophotographic image forming means; and setting means for selectively setting one of a first conveying mode using said first conveying path, a second conveying mode using said second conveying path, and a third conveying mode using said third conveying path.

18. An image forming apparatus according to claim 17, wherein said third conveying path further comprises a fourth conveying path for connecting an exit of said second conveying path to an entrance of said first conveying path, and wherein when the third conveying mode is set, the recording medium is conveyed through said second conveying path, said fourth conveying path, and said first conveying path.

19. An image forming apparatus according to claim 17 or 18, further comprising:

a first feeding tray for feeding the recording medium to said first conveying path;

a first discharging tray for discharging the recording medium on which image formation has been performed by said ink-jet image forming means while passing through said first conveying path;

a second feeding tray for feeding the recording medium to said second conveying path; and a second discharging tray for discharging the recording medium on which image formation has been performed by said electrophotographic image forming means while passing through said second conveying path, wherein said first conveying path is disposed above said second conveying path, wherein said first feeding tray is disposed above said second feeding tray, and wherein said first discharging tray is disposed above said second discharging tray.

20. An image forming apparatus according to claim 19, further comprising:

an additional conveying path for connecting an exit of said second conveying path to said first discharging tray, wherein the recording medium passing through said second conveying path can be selectively discharged onto one of said first discharging tray and said second discharging tray.

21. An image forming apparatus according to claim 18, further comprising:

a first feeding tray for feeding the recording medium to said first conveying path;

a first discharging tray for discharging the recording medium on which image formation has been performed by said ink-jet image forming means while passing through said first conveying path;

a second feeding tray for feeding the recording medium to said second conveying path; and a second discharging tray for discharging the recording medium on which image formation has been performed by said electrophotographic image forming means while passing through said second conveying path, wherein said first conveying path is disposed above said second conveying path, said first feeding tray is disposed above said second feeding tray, and said first discharging tray is disposed above said second discharging tray, and wherein when the first conveying mode is set, the recording medium fed from said first feeding tray passes through said first conveying path, and is discharged onto said first discharging tray after image formation by said ink-jet image forming means has been performed, when the second conveying mode is set, the recording medium fed from said second feeding tray passes through said second conveying path, and is discharged onto said second discharging tray after image formation by said electrophotographic image forming means has been performed, and when the third conveying mode is set, the recording medium fed from said second feeding tray passes through said second conveying path, then passes through said fourth conveying path to said first conveying path after image formation by said electrophotographic image forming means has been performed, and is discharged onto said first discharging tray after image formation by said ink-jet image forming means has been performed.

22. An image forming apparatus according to claim 17 or 18, further comprising:

control means for reducing power consumption in said electrophotographic image forming means when the first conveying mode is set, and for reducing power consumption in said ink-jet image forming means when the second conveying mode is set.

23. An image forming apparatus according to claim 17, wherein said ink-jet image forming means comprises an electrothermal transducer for generating thermal energy for discharging the ink as a liquid.

24. An image forming apparatus according to claim 23, wherein said ink-jet image forming means discharges the ink liquid from discharging ports utilizing film boiling generated in the ink liquid by thermal energy supplied from said electrothermal transducer.

25. An image forming apparatus according to claim 17, wherein said setting means comprises an image-data separation/determination circuit, and wherein the conveying mode is set based on determination of said image-data separation/determination circuit whether image data input from an external apparatus comprises only monochrome-image data, only a color-image data, or both monochrome-image data and color-image data.

26. An image forming apparatus for forming an image on a recording medium, said apparatus comprising:

ink-jet image forming means for performing image formation according to an ink-jet image forming method of performing image formation by discharging an ink liquid from nozzles;

a first conveying path for conveying a recording medium in order to form an image thereon using said ink-jet image forming means;

electrophotographic image forming means for performing image formation according to an electrophotographic image forming method;

a second conveying path for conveying a recording medium in order to form an image thereon using said electrophographic image forming means;

a guiding conveying path for guiding a recording medium, on which image formation has been completed by said electrophotographic image forming means while passing through said second conveying path, to said first conveying path; and setting means for selectively setting one of (i) a first conveying mode for forming a color image on the recording medium by conveying the recording medium through said first conveying path, (ii) a second conveying mode for forming a monochrome image on the recording medium by conveying the recording medium through said second conveying path, and (iii) a third conveying mode for forming a color image after forming a monochrome image on the recording medium by conveying the recording medium through said first conveying path, said guiding conveying path and said second conveying path.

27. An image forming apparatus for forming an image on a recording medium, said apparatus comprising:

electrophotographic image forming means for performing image formation according to an electrophotographic image forming method;

a first conveying path for conveying a recording medium in order to form an image thereon using said electrophotographic image forming means;

ink-jet image forming means for performing image formation according to an ink-jet image forming method of performing image formation by discharging an ink liquid from nozzles;

a second conveying path for conveying a recording medium in order to form an image thereon using said ink-jet image forming means;

a guiding conveying path for guiding a recording medium, on which image formation has been completed by said electrophotographic image forming means while passing through said second conveying path, to said first conveying path; and setting means for selectively setting one of (i) a first conveying mode for forming a monochrome image on the recording medium by conveying the recording medium through said first conveying path, (ii) a second conveying mode for forming a color image on the recording medium by conveying the recording medium through said second conveying path, and (iii) a third conveying mode for forming a monochrome image after forming a color image on the recording medium by conveying the recording medium through said first conveying path, said guiding conveying path, and said second conveying path.

28. An image forming apparatus according to claim 26 or 27, wherein said guiding conveying path connects an exit of said second conveying path to an entrance of said first conveying path.

29. An image forming apparatus according to claim 26, further comprising:

a first feeding tray for feeding the recording medium to said first conveying path;

a first discharging tray for discharging the recording medium on which image formation has been performed by said ink-jet image forming means while passing through said first conveying path;

a second feeding tray for feeding the recording medium to said second conveying path; and a second discharging tray for discharging the recording medium on which image formation has been performed by said electrophotographic image forming means while passing through said second conveying path, wherein said first conveying path is disposed above said second conveying path, wherein said first feeding tray is disposed above said second feeding tray, and wherein said first discharging tray is disposed above said second discharging tray.

30. An image forming apparatus according to claim 29, further comprising:

an additional conveying path for connecting an exit of said second conveying path to said first discharging tray, wherein the recording medium passing through said second conveying path can be selectively discharged onto one of said first discharging tray and said second discharging tray.

31. An image forming apparatus according to claim 27, further comprising:

a first feeding tray for feeding the recording medium to said first conveying path;

a first discharging tray for discharging the recording medium on which image formation has been performed by said electrophotographic image forming means while passing through said first conveying path;

a second feeding tray for feeding the recording medium to said second conveying path; and a second discharging tray for discharging the recording medium on which image formation has been performed by said ink-jet image forming means while passing through said second conveying path;

wherein said first conveying path is disposed above said second conveying path, wherein said first feeding tray is disposed above said second feeding tray, and wherein said first discharging tray is disposed above said second discharging tray.

32. An image forming apparatus according to claim 31, further comprising:

an additional conveying path for connecting an exit of said second conveying path to said first discharging tray, wherein the recording medium passing through said second conveying path can be selectively discharged onto one of said first discharging tray and said second discharging tray.

33. An image forming apparatus according to claim 26, further comprising:

control means for reducing power consumption in said ink-jet image forming means when the first conveying mode is set, and for reducing power consumption in said electrophotographic image forming means when the second conveying mode is set.

34. An image forming apparatus according to claim 27, further comprising:

control means for reducing power consumption in said electrophotographic image forming means when the first conveying mode is set, and for reducing power consumption in said ink-jet image forming means when the second conveying mode is set.

35. An image forming apparatus according to claim 26, wherein said ink-jet image forming means comprises an electrothermal transducer for generating thermal energy for discharging the ink liquid.

36. An image forming apparatus according to claim 25, wherein said ink-jet image forming means discharges the ink liquid from discharging ports of said nozzles utilizing film boiling generated in the ink liquid by the thermal energy supplied from said electrothermal transducer.

37. An image forming apparatus according to claim 26 or 27, wherein said setting means comprises an image-data separation/determination circuit, and wherein the conveying mode is set based on determination of said image-data separation/determination circuit whether image data input from an external apparatus comprises only monochrome-image data, only color-image data, or both monochrome-image data and color-image data.

* * * * *

UNITED STATES PATENT AND TRADEMARK OFFICE

CERTIFICATE OF CORRECTION

PATENT NO. : 5,729,785 Page 1 of 2

DATED : March 17, 1998

INVENTOR(S) : KATSUHIRO SAKAIZAWA, ET AL.

It is certified that error appears in the above-identified patent and that said Letters Patent is hereby corrected as shown below:

COLUMN 1:

Line 24, "1" should read --11--.

COLUMN 6:

Line 38, "Li" should read --$L_1$--.

COLUMN 8:

Line 7, "58" should read --53--.

COLUMN 14:

Line 14, "93" should read --53--.

COLUMN 19:

Line 40, "where in" should read --wherein--.

UNITED STATES PATENT AND TRADEMARK OFFICE

CERTIFICATE OF CORRECTION

PATENT NO. : 5,729,785 Page 2 of 2

DATED : March 17, 1998

INVENTOR(S) : KATSUHIRO SAKAIZAWA, ET AL.

It is certified that error appears in the above-identified patent and that said Letters Patent is hereby corrected as shown below:

COLUMN 24:

Line 40, "25" should read --35--.

Signed and Sealed this

Thirteenth Day of October 1998

*Attest:*

*Attesting Officer*

BRUCE LEHMAN

*Commissioner of Patents and Trademarks*